US011389800B2

(12) United States Patent
Sperling et al.

(10) Patent No.: US 11,389,800 B2
(45) Date of Patent: Jul. 19, 2022

(54) SYSTEMS AND METHODS FOR DROPLET PRODUCTION AND/OR FLUIDIC MANIPULATION

(71) Applicant: President and Fellows of Harvard College, Cambridge, MA (US)

(72) Inventors: Ralph Alexander Sperling, Eltville (DE); Adam R. Abate, San Francisco, CA (US); David A. Weitz, Bolton, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 92 days.

(21) Appl. No.: 14/348,113

(22) PCT Filed: Sep. 27, 2012

(86) PCT No.: PCT/US2012/057404
§ 371 (c)(1),
(2) Date: Mar. 28, 2014

(87) PCT Pub. No.: WO2013/095737
PCT Pub. Date: Jun. 27, 2013

(65) Prior Publication Data

US 2014/0338753 A1 Nov. 20, 2014

Related U.S. Application Data

(60) Provisional application No. 61/540,194, filed on Sep. 28, 2011.

(51) Int. Cl.
*B01L 3/00* (2006.01)
*B01F 23/41* (2022.01)
(Continued)

(52) U.S. Cl.
CPC ..... *B01L 3/502784* (2013.01); *B01F 23/41* (2022.01); *B01F 33/3011* (2022.01);
(Continued)

(58) Field of Classification Search
CPC ..... B01L 3/502761; B01L 3/502784; B01L 3/50273; B01L 3/5025
See application file for complete search history.

(56) References Cited

U.S. PATENT DOCUMENTS 7,708,949 B2 5/2010 Stone et al.
8,658,430 B2 2/2014 Miller et al.
(Continued)

FOREIGN PATENT DOCUMENTS

CN 101500694 A 8/2009
CN 201681080 U 12/2010
(Continued)

OTHER PUBLICATIONS

61/341218 Appendix dated Mar. 25, 2010 (Year: 2010).*
(Continued)

*Primary Examiner* — Jennifer Wecker
*Assistant Examiner* — Jonathan Bortoli
(74) *Attorney, Agent, or Firm* — Wolf, Greenfield & Sacks, P.C.

(57) ABSTRACT

The present invention generally relates to systems and techniques for manipulating fluids and/or making droplets. In certain aspects, the present invention generally relates to droplet production. The droplets may be formed from fluids from different sources. In one set of embodiments, the present invention is directed to a microfluidic device comprising a plurality of droplet-making units, and/or other fluidic units, which may be substantially identical in some cases. Substantially each of the fluidic units may be in fluidic communication with a different source of a first fluid and a
(Continued)

common source of a second fluid, in certain embodiments. In one aspect, substantially the same pressure may be applied to substantially all of the different sources of fluid, which may be used to cause fluid to move from the different sources into the microfluidic device. In some cases, the fluids may interact within the fluidic units, e.g., by reacting, or for the production of droplets within the microfluidic device. In some cases, the droplets may be used, for example, to form a library of droplets.

17 Claims, 4 Drawing Sheets

(51) Int. Cl.
*B01F 33/3011* (2022.01)
*B01F 33/302* (2022.01)
*B01L 3/02* (2006.01)

(52) U.S. Cl.
CPC ..... *B01F 33/3021* (2022.01); *B01L 3/0268* (2013.01); *B01L 2200/0673* (2013.01); *B01L 2300/0816* (2013.01); *B01L 2300/0867* (2013.01); *B01L 2300/0883* (2013.01); *Y10T 137/0391* (2015.04); *Y10T 137/212* (2015.04)

(56) References Cited

U.S. PATENT DOCUMENTS 9,358,539 B2 7/2016 Abate et al.
10,029,256 B2 7/2018 Abate et al.
2002/0019059 A1* 2/2002 Chow ..... B01L 3/5027 436/514
2002/0058332 A1* 5/2002 Quake ..... B01L 3/502761 435/288.5
2003/0017467 A1* 1/2003 Hooper ..... B01J 19/0046 435/6.11
2005/0172476 A1* 8/2005 Stone ..... B01L 3/5027 29/592.1
2005/0267270 A1 12/2005 Fitzgerald et al.
2005/0272159 A1* 12/2005 Ismagilov ..... B01F 5/0646 436/34
2006/0163385 A1 7/2006 Link et al.
2006/0275915 A1 12/2006 Sowerby et al.
2007/0003442 A1 1/2007 Link et al.
2007/0052781 A1 3/2007 Fraden et al.
2007/0242560 A1* 10/2007 Norikane ..... B01F 3/0807 366/167.1
2007/0246106 A1 10/2007 Tonkovich et al.
2008/0014589 A1 1/2008 Link et al.
2008/0044893 A1* 2/2008 Pollack ..... C07K 1/1136 435/305.3
2008/0226516 A1 9/2008 Suzuki et al.
2009/0131543 A1 5/2009 Weitz et al.
2010/0018584 A1 1/2010 Bransky et al.
2010/0173394 A1 7/2010 Colston et al.
2011/0053798 A1* 3/2011 Hindson ..... C12Q 1/6844 506/12
2011/0086780 A1* 4/2011 Colston, Jr. ..... B01F 3/0807 506/23
2011/0092373 A1 4/2011 Colston, Jr. et al.
2011/0092376 A1 4/2011 Colston, Jr. et al.
2011/0092392 A1 4/2011 Colston, Jr. et al.
2011/0151578 A1 6/2011 Abate et al.
2011/0159499 A1 6/2011 Hindson et al.
2011/0217711 A1 9/2011 Hiddessen et al.
2011/0217712 A1 9/2011 Hiddessen et al.
2011/0217736 A1 9/2011 Hindson
2011/0229545 A1 9/2011 Shum et al.
2011/0311978 A1 12/2011 Makarewicz, Jr. et al.
2012/0021423 A1 1/2012 Colston, Jr. et al.
2012/0121481 A1* 5/2012 Romanowsky ..... B01F 3/0807 422/502
2012/0190032 A1* 7/2012 Ness ..... G01N 35/085 435/6.12
2016/0250638 A1 9/2016 Abate et al.
2017/0151536 A1 6/2017 Romanowsky et al.

FOREIGN PATENT DOCUMENTS

CN 102059162 A 5/2011
CN 102124259 A 7/2011
EP 2 347 245 A1 7/2011
EP 1 810 746 B1 11/2011
EP 2 480 324 A2 8/2012
GB 2477053 A 7/2011
WO WO1984/02000 * 5/1984
WO WO 2003/037502 A1 5/2003
WO WO 2007/039265 A1 4/2007
WO 2007/133710 A2 11/2007
WO WO 2008/121342 A2 10/2008
WO WO 2010/013238 A2 2/2010
WO WO 2010/033200 A2 3/2010
WO WO-2010033200 A2 * 3/2010 ..... B01J 13/04
WO WO 2010/036352 A1 4/2010
WO WO 2010/104597 A2 9/2010
WO WO 2011/028539 A1 3/2011
WO WO 2011/028764 A2 3/2011
WO WO 2011/034621 A2 3/2011
WO WO 2011/056546 A1 5/2011
WO WO 2011/066361 A1 6/2011
WO WO 2011/066476 A1 6/2011
WO WO 2011/109546 A1 9/2011
WO WO 2011/120020 A1 9/2011
WO WO 2011/120024 A1 9/2011
WO WO-2011120024 A1 * 9/2011 ..... B01L 3/502784
WO WO 2013/095737 A2 6/2013

OTHER PUBLICATIONS

61/341,218 specification, dated Mar. 25, 2010 (Year: 2010).*
Chinese Office Action for Application No. CN 201280058334.3 dated Feb. 14, 2016.
International Search Report and Written Opinion dated Jul. 15, 2013 for PCT/US2012/057404.
International Preliminary Report on Patentability dated Apr. 1, 2014 for PCT/US2012/057404.
[No Author Listed] Pressure-driven, parallel generation of droplet libraries. 45th New England Workshop on Complex Fluids. Materials Research Science and Engineering Center Harvard University. Dec. 3, 2010.
Chinese Office Action for Application No. 201280058334.3 dated Sep. 2, 2015.
Chinese Office Action for Application No. 201280058334.3 dated Jan. 13, 2015.
European Extended Search Report for Application No. 12860342.0 dated Apr. 15, 2015.
European Office Communication dated Oct. 14, 2016 for Application No. EP 12860342.0.
Chinese Office Action dated Apr. 10, 2018 for Application No. 201610842741.3.
Final Written Decision from the Patent Trial and Appeal Board entered Jan. 18, 2017 for case No. IPR2015-01558 (U.S. Pat. No. 8,658,430). *10X Genomics, Inc.* vs. *Raindance Technologies*. Entered by Vice Chief Administrative Patent Judge Michael P. Tierney and Administrative Patent Judges Tina E. Hulse and Elizabeth M. Roesel. 50 pages.
Nguyen et al., Optical detection for droplet size control in microfluidic droplet-based analysis systems. Sensors and Actuators B: Chemical. Oct. 1, 2006; 117(2): 431-436.
Chinese Office Action dated Nov. 27, 2018 for Application No. CN 201601842741.3.
European Office Action dated Dec. 10, 2018 for Application No. EP 12860342.0.
Chinese Office Action dated May 29, 2019 for Application No. 201610842741.3.
Summons to Attend Oral Proceedings dated Aug. 23, 2019 for Application No. EP 12860342.0.

(56) References Cited

OTHER PUBLICATIONS

Chinese Rejection Decision dated Dec. 19, 2019 for Application No. CN 201610842741.3.
Chinese Office Action dated Jul. 27, 2020 for Application No. CN 201610842741.3.

* cited by examiner

SYSTEMS AND METHODS FOR DROPLET PRODUCTION AND/OR FLUIDIC MANIPULATION

RELATED APPLICATIONS

This application claims the benefit of U.S. Provisional Patent Application Ser. No. 61/540,194, filed Sep. 28, 2011, entitled "Systems and Methods for Droplet Production and/or Fluidic Manipulation," by Sperling, et al., incorporated herein by reference in its entirety.

GOVERNMENT FUNDING

This invention was made with government support under 1006546 and 0820484 awarded by National Science Foundation (NSF). The government has certain rights in this invention.

FIELD OF INVENTION

The present invention generally relates to systems and techniques for manipulating fluids and/or making droplets.

BACKGROUND

Microfluidics is an area of technology involving the control of fluid flow at a very small scale. Microfluidic devices typically include very small channels, within which fluid flows, which can be branched or otherwise arranged to allow fluids to be combined with each other, to divert fluids to different locations, to cause laminar flow between fluids, to dilute fluids, and the like. Significant effort has been directed toward "lab-on-a-chip" microfluidic technology, in which researchers seek to carry out known chemical or biological reactions on a very small scale on a "chip," or microfluidic device. Additionally, new techniques, not necessarily known on the macro scale, are being developed using microfluidics.

For instance, the manipulation of fluids to form fluid streams of desired configurations, discontinuous fluid streams, droplets, particles, dispersions, etc., for purposes of fluid delivery, product manufacture, analysis, and the like, is a relatively well-studied art. For example, highly monodisperse droplets, less than 100 micrometers in diameter, have been produced using a technique commonly referred to as flow focusing. In this technique, a fluid is forced out of a capillary tube into a bath of liquid, where the tube is positioned above a small orifice, and the contraction flow of the external liquid through this orifice focuses the gas into a thin jet which subsequently breaks into equal-sized droplets via capillary instability. A similar arrangement can be used to produce liquid droplets in air.

However, despite such progress, there still remains a need for improvement in techniques useful in the creation of droplets.

SUMMARY

The present invention generally relates to systems and techniques for manipulating fluids and/or making droplets. The subject matter of the present invention involves, in some cases, interrelated products, alternative solutions to a particular problem, and/or a plurality of different uses of one or more systems and/or articles.

In one aspect, the present invention is generally directed to a method. In one set of embodiments, the method includes acts of providing a microfluidic device comprising a plurality of droplet-making units, where substantially each of the droplet-making units may be in fluidic communication with a different source of droplet fluid and a common source of carrier fluid; applying substantially the same pressure and/or pressure drop to substantially all of the different sources of droplet fluid to cause droplet fluid to move from the different sources of droplet fluid into the microfluidic device; and producing, within the microfluidic device, a set comprising a plurality of droplets, where substantially each droplet of the set may comprise droplet fluid from only one of the different sources of droplet fluid. In some embodiments, the plurality of droplets of the set may be contained within carrier fluid from the common source of carrier fluid.

The method, in another set of embodiments, includes acts of providing a microfluidic device comprising a plurality of fluidic units, where substantially each of the fluidic units may be in fluidic communication with a different source of a first fluid and a common source of a second fluid; applying substantially the same pressure and/or pressure drop to substantially all of the different sources of the first fluid to cause the first fluid to move from the different sources of the first fluid into the microfluidic device; and producing, within substantially each of the fluidic units the microfluidic device, a plurality of mixtures of the first and second fluids. In some cases, substantially each mixture of the plurality of mixtures comprises first fluid from only one of the different sources of first fluid and the second fluid from the common source of the second fluid.

The invention, in another set of embodiments, is directed to an article. In accordance with one set of embodiments, the article includes a microfluidic device comprising a plurality of droplet-making units. In some instances, substantially each of the droplet-making units is in fluidic communication with a different source of droplet fluid and a common source of carrier fluid. In some cases, the droplet-making units are positioned at a repeat spacing of about 9 mm, about 4.5 mm, or about 2.25 mm.

The article, in another set of embodiments, includes a microfluidic device comprising a plurality of droplet-making units. In some embodiments, substantially each of the droplet-making units is in fluidic communication with a different source of droplet fluid and a common source of carrier fluid. In certain cases, at least one of the droplet-making units comprises an inlet for receiving droplet fluid from one of the different sources of droplet fluid, where the inlet may be in fluidic communication via a first microfluidic channel with an intersection of microfluidic channels; and a second microfluidic channel extending from the intersection, where the second microfluidic channel may be in fluid communication with the common source of carrier fluid. In some cases, at least one of the first or second microfluidic channels has a length within the droplet-making unit that is greater than two times the largest dimension of the droplet-making unit.

In yet another set of embodiments, the article includes a microfluidic device comprising a plurality of droplet-making units. In some embodiments, substantially each of the droplet-making units is in fluidic communication with a different source of droplet fluid and a common source of carrier fluid. In certain cases, at least one of the droplet-making units comprises an inlet for receiving droplet fluid from one of the different sources of droplet fluid, where the inlet may be in fluidic communication via a first microfluidic channel with an intersection of microfluidic channels; and a second microfluidic channel extending from the intersection, where the second microfluidic channel may be in fluid communication with the common source of carrier fluid. In some cases, at least one of the first or second microfluidic channels exhibits a first section and a second section that is substantially antiparallel to the first section.

The article, in another set of embodiments includes a microfluidic device comprising a plurality of droplet-making units, a pressurizing fluid in fluidic communication with substantially all of the different sources of droplet fluid, and a pressure source able to alter the pressure of the pressurizing fluid. In some embodiments, substantially each of the droplet-making units is in fluidic communication with a different source of droplet fluid and a common source of carrier fluid.

In yet another set of embodiments, the article may include a microfluidic device comprising a plurality of fluidic units. In some cases, substantially each of the fluidic units may be in fluidic communication with a different source of a first fluid and a common source of a second fluid. In certain embodiments, at least one of the fluidic units comprises an inlet for receiving first fluid from one of the different sources of the first fluid, where the inlet may be in fluidic communication via a first microfluidic channel with an intersection of microfluidic channels; and a second microfluidic channel extending from the intersection, where the second microfluidic channel may be in fluid communication with the common source of the second fluid. In some embodiments, at least one of the first or second microfluidic channels has a length within the fluidic unit that is greater than two times the largest dimension of the fluidic unit.

The article, in still another set of embodiments, is generally directed to a microfluidic device comprising a plurality of fluidic units, where substantially each of the fluidic units may be in fluidic communication with a different source of a first fluid and a common source of a second fluid. In some embodiments, at least one of the fluidic units may comprise an inlet for receiving first fluid from one of the different sources of the first fluid, where the inlet may be in fluidic communication via a first microfluidic channel with an intersection of microfluidic channels; and a second microfluidic channel extending from the intersection, where the second microfluidic channel may be in fluid communication with the common source of the second fluid. In some embodiments, at least one of the first or second microfluidic channels exhibits a first section and a second section that is substantially antiparallel to the first section.

According to still another set of embodiments, the article may be generally directed to a microfluidic device comprising a plurality of fluidic units, where substantially each of the fluidic units may be in fluidic communication with a different source of a first fluid and a common source of a second fluid; a pressurizing fluid in fluidic communication with substantially all of the different sources of first fluid; and a pressure source able to alter the pressure of the pressurizing fluid.

In another aspect, the present invention encompasses methods of making one or more of the embodiments described herein, for example, a plurality of droplets, which may include different sources of droplet fluid. In still another aspect, the present invention encompasses methods of using one or more of the embodiments described herein, for example, a plurality of droplets, which may include different sources of droplet fluid.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

The present invention generally relates to systems and techniques for manipulating fluids and/or making droplets. In certain aspects, the present invention generally relates to droplet production. The droplets may be formed from fluids from different sources. In one set of embodiments, the present invention is directed to a microfluidic device comprising a plurality of droplet-making units, and/or other fluidic units, which may be substantially identical in some cases. Substantially each of the fluidic units may be in fluidic communication with a different source of a first fluid and a common source of a second fluid, in certain embodiments. In one aspect, substantially the same pressure may be applied to substantially all of the different sources of fluid, which may be used to cause fluid to move from the different sources into the microfluidic device. In some cases, the fluids may interact within the fluidic units, e.g., by reacting, or for the production of droplets within the microfluidic device. In some cases, the droplets may be used, for example, to form a library of droplets.

Figure 1A:
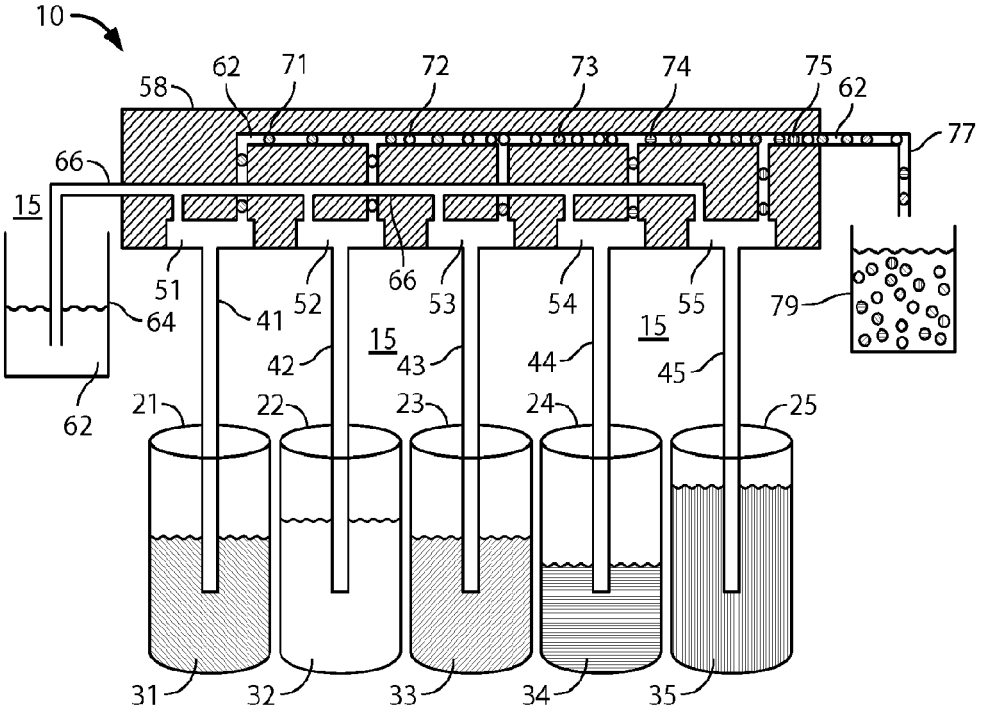
FIGS. 1A-1B illustrate devices for making droplets in accordance with certain embodiments of the invention.

One non-limiting example of an aspect of the invention is now described with respect to FIG. 1. In this figure, microfluidic system 10 comprises a plurality of sources of droplet fluid 21, 22, 23, 24, and 25, each containing droplet fluid 31, 32, 33, 34, and 35. Although only five sources of droplet fluid are shown here, this is by way of explanation only, and in other embodiments of the invention, other numbers of sources of droplet fluid may be present. As non-limiting examples, there may be 6, 24, 96, 384, or 1,536 sources of droplet fluid present.

The droplet fluid in each of the sources of droplet fluid may independently be the same or different. For instance, there may be one or more than one type of droplet fluid present in each source of droplet fluid 21, 22, 23, 24, and 25. In some cases, the droplet fluid can be substantially identical except that some or all of the sources of droplet fluid may contain different species. As non-limiting examples, the sources of droplet fluid 21, 22, 23, 24, and 25, etc. may contain the same droplet fluid, except containing different species, and/or the same species at various concentrations. In FIG. 1, the droplet fluid in each source of droplet fluid is shaded differently to aid in identification.

Inserted in each source of droplet fluid 21, 22, 23, 24, and 25 are tubes 41, 42, 43, 44, and 45. These tubes may have the same or different sizes or diameters. Droplet fluid from sources 21, 22, 23, 24, and 25 flows through tubes 41, 42, 43, 44, and 45 into a plurality of droplet-making units 51, 52, 53, 54, and 55 contained within microfluidic device 58. The fluid may be brought into microfluidic device 58 using any suitable technique. For example, a pump such as a syringe pump may be used to pump fluid into microfluidic device 58, or the fluid can be drawn there via capillary action. In one set of embodiments, an external pressure may be used; as shown in FIG. 1, the plurality of sources of droplet fluid 21, 22, 23, 24, and 25 are open to the surrounding environment 15, and in some embodiments, the pressure of the surrounding environment may be increased (e.g., relative to the pressure within microfluidic device 58, such that droplet fluid is driven by the differences in pressure into microfluidic device 58). For example, microfluidic device 58 may be contained within a pressure chamber, and the pressure within the pressure chamber may be controlled to control the delivery of fluid from sources of droplet fluid 21, 22, 23, 24, and 25 into microfluidic device 58.

Microfluidic device 58 also contains channel 66, which is in fluidic communication to a source 64 of carrier fluid 62. Carrier fluid 62 flows through channel 66 within microfluidic device 58 to droplet-making units 51, 52, 53, 54, and 55, etc. Although only one channel 66 is shown in this example, this is by way of example only, and in other embodiments, there may be more than one such channel in fluid communication with source 64 of carrier fluid 62. Carrier fluid 62 from source 64 may be moved into microfluidic device 58 using techniques similar to those described above; for example, one or more pumps can be used to deliver the carrier fluid, or the fluid may flow via capillary action. In another example, as shown in FIG. 1, a difference in pressure between the surrounding environment 16 and the pressure within microfluidic device 58 may be used to move carrier fluid 62 towards droplet-making units 51, 52, 53, 54, and 55, etc. Surrounding environment 16 may or may not be the same as environment 15 surrounding the plurality of sources of droplet fluid 21, 22, 23, 24, and 25, etc. For example, the pressure surrounding environment 16 may be at the same pressure (or a different pressure) than environment 15. In addition, in some embodiments, the technique used to move carrier fluid 62 into microfluidic device 58 may be the same or different than the technique used to move droplet fluid 31, 32, 33, 34, and 35, etc. into the microfluidic device. As a non-limiting example, pressure may be used to move droplet fluid 31, 32, 33, 34, and 35 into microfluidic device 58, while a pump such as a syringe pump may be used to move carrier fluid 62 into microfluidic device 58.

Within droplet-making units 51, 52, 53, 54, and 55, a plurality of droplets 71, 72, 73, 74, and 75, may be produced such that droplet fluid 31, 32, 33, 34, and 35, forms discrete droplets surrounded by a common carrier fluid 62. As shown in FIG. 1, the droplets are collected in collector channel 77 within microfluidic device 58. Although one collector channel is shown in this figure, this is by way of example only, and in other embodiments, more than one collector channel may be used. For example, in some embodiments, some or all of the droplet-making units may have a separate collector channel, for instance, leading to a common container, and/or to a plurality of containers, e.g., separate containers in some cases. The droplets produced by the various droplet-making units can be mixed together in some embodiments, as is shown in this figure, although in other embodiments, the droplets may be kept separate. In this figure, the droplets are combined within collector channel 77 to form a plurality of droplets contained within a common carrier fluid, where the plurality of droplets may be the same or different. In some cases, the droplets may also be mixed together randomly. The plurality of droplets is then collected from the collector channel 77, for various uses, e.g., as shown by collection of droplets 79 at the outlet of collector channel 77.

As mentioned above, in various embodiments, a plurality of droplet-making units 51, 52, 53, 54, and 55 is used to combine a droplet fluid and a carrier fluid together to form a droplet of droplet fluid surrounded or contained by the carrier fluid. A non-limiting example of such a process of producing such droplets with a droplet-making unit is now illustrated with respect to FIG. 1B. Other examples are described in more detail below.

Figure 1B:
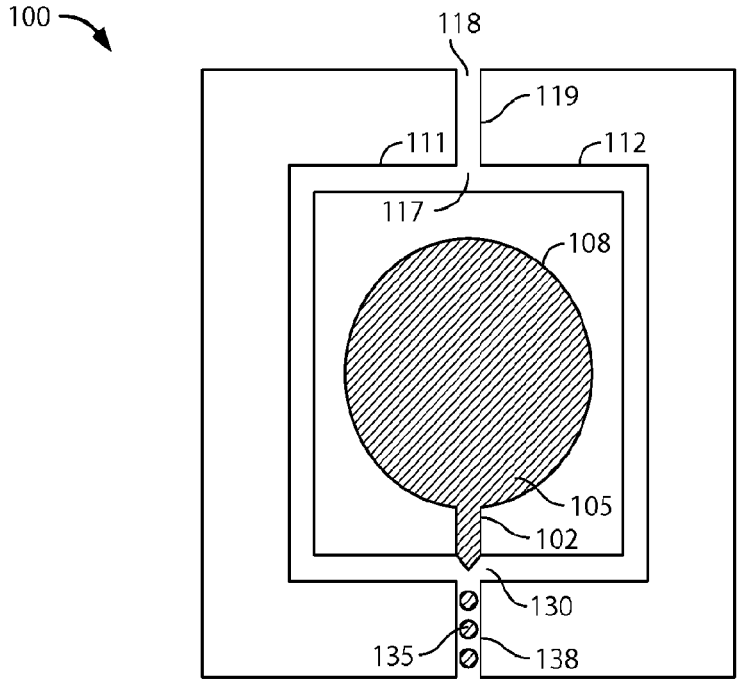

In FIG. 1B, droplet fluid 105 (e.g., arising from a tube in fluidic communication with a source of droplet fluid, as previously discussed) enters droplet-making unit 100 at inlet 108 (e.g., from out of the plane of the paper). As shown here, inlet 108 is substantially circular, although other shapes are also possible. Droplet fluid 105 then leaves inlet 108 through channel 102. Carrier fluid 115 (e.g., arising from a channel in fluidic communication with a source of carrier fluid) also enters droplet-making unit 100. In this example, carrier fluid 115 enters from the top of droplet-making unit 100 through inlet 118 into channel 119. At intersection 117, channel 119 divides into two channels 111, 112, which each flow in different directions around inlet 105, eventually meeting at intersection 130 with channel 102 from inlet 108. At intersection 130, the flow of carrier fluid and droplet fluid causes droplets 135 of droplet fluid to form, surrounded by the carrier fluid. Droplets 135 may then exit through outlet channel 138 and outlet 139.

As mentioned, various aspects of the present invention are generally related to systems and methods for making droplets and/or methods of manipulating fluids, e.g., in a microfluidic system. In certain embodiments, one or more fluids from one or more sources of a first fluid can be combined or mixed with one or more second fluids from one or more sources of second fluid, e.g., in a fluidic unit. There may be one or more fluidic units present within a microfluidic device, and in some embodiments, the fluidic units may be substantially identical. For instance, in some cases, one or more droplet fluids from one or more sources of droplet fluid can be combined with one or more carrier fluids from one or more sources of carrier fluid to produce droplets contained within the carrier fluid. The fluids may be combined within one or more droplet-making units, e.g., contained within a microfluidic device, and the droplet-making units may be substantially identical in some cases.

One or more sources of second fluid (e.g., carrier fluids or other suitable fluids) may be used in various embodiments of the invention. For example, there may be 2, 3, 4, 5, 6, etc. sources of fluid present. In some cases, a common source of fluid is used to supply fluid to substantially all of the fluidic units; for instance, a common source of carrier fluid can be used to supply carrier fluid to substantially all of the droplet-making units within a microfluidic device. A source of fluid can be located within the microfluidic device, or positioned externally of the microfluidic device. For example, a common source of fluid may include one or more containers, such as vials, ampules, beakers, bottles, flasks, microwell plates, pipettes, etc. If more than one container is used, e.g., with multiple common sources of fluid, the containers may independently be the same or different.

There may also be one or more sources of first fluid present. For example, as mentioned, droplets can be created using one or more sources of droplet fluid, for example, in cases where the creation of a library of droplets is desired. The sources of fluid that are present may independently be the same or different. For example, in one embodiment, the fluid within the various sources of fluid may each be substantially identical; in another embodiment, each of the fluids within the sources of fluid may be different or distinguishable. In certain embodiments, however, some but not all of the sources of fluid are substantially identical, for example, if duplicates, triplicates, etc. of a certain type of fluid are needed. In some embodiments, some or all of the sources of fluid may be substantially identical except for the presence of one or more species contained within some or all of the fluids. For example, different sources of fluid may contain different species, and/or the same species at different concentrations (and/or any combination thereof). For instance, in some embodiments, substantially each of the different sources of fluid contains the same solvent; for example, the different sources of fluid may contain the same solvent but different species, and/or the same species at various concentrations (and/or any combination thereof).

There can be any number of sources of fluid present. For instance, there may be 2 or more, 3 or more, 4 or more, 5 or more, 6 or more, 10 or more, 15 or more, 20 or more, 24 or more, 30 or more, 35 or more, 40 or more, 45 or more, 50 or more, etc. of sources of fluid present. In one embodiment, there are 2n×3n or more sources of fluid present, where n is a positive integer, e.g., n may be 1, 2, 3, 4, 5, 6, 7, 8, 9, 10, 11, 12, 13, 14, 15, 16, etc.

The sources of fluid may be present in any suitable form. For example, the sources of fluid may include one or more containers, such as vials, ampules, beakers, bottles, flasks, microwell plates, pipettes, etc., or any combination of these and/or other suitable contains. If more than one container is used, the containers may independently be the same or different. In one set of embodiments, for example, fluid may be contained within one or more microwells of a microwell plate, e.g., an ANSI microwell plate. Many such ANSI microwell plates are known to those of ordinary skill in the art, and typically, an ANSI microwell plate will contain 2n×3n wells, where n is a positive integer. Thus, for example, there may be 6, 24, 96, 384, 1,536, etc. sources of droplet fluid present, e.g., in an ANSI microwell plate format. However, it should be understood that not all wells of an ANSI microwell plate must be used, and some of the microwells on the microwell plate may be left empty or unused as a source of fluid to the device. Thus, for example, about ½, about ⅓, about ¼, about ⅔, or any other suitable fraction of microwells on a microwell plate can be used.

The sources of fluid may be in fluidic communication with one or more fluidic units, e.g., droplet-making units, in another aspect. For example, one or more tubes, channels, or the like can be positioned between a source of fluid and one or more fluidic units, and if more than one fluidic unit is present, each of the fluidic communications with a source of fluid may independently be the same or different. The fluidic units may be used in accordance with some embodiments to mix or react a first fluid (e.g., from a first source of fluid) and a second fluid (e.g., from a second source of fluid). For example, as discussed in more detail below, a fluidic unit may act as a droplet-making unit that can be used to combine a first fluid from a source of first fluid (or droplet fluid) with a second fluid from a source of second fluid (or carrier fluid) to produce a droplet of droplet fluid contained within the carrier fluid.

There may be any number of such fluidic units present, e.g., in a microfluidic device. In some cases, there may be the same number of fluidic units present in the microfluidic device as there are on an ANSI microwell plate, e.g., one that the microfluidic device would be connected to (for example, an ANSI microwell plate used as a source of fluid). Thus, in one set of embodiments, there may be 2n×3n fluidic units present in the device, where n is a positive integer, e.g., there may be 6, 24, 96, 384, 1,536, etc. fluidic units present. In other embodiments, however, only a portion of an ANSI microwell plate may be used. Thus, for example, the number of fluidic units in a device can be about ½, about ⅓, about ¼, about ⅔, or any other suitable fraction of the number of microwells on a microwell plate. In still other embodiments, there may be any number of fluidic units present in the microfluidic device. For example, there may be 1, 2, 3, 4, 5, 6, 8, 10, 12, 15, 20, 25, 30, 35, 40, 50, 60, 75, 100, 200, 300, etc. fluidic units present in a microfluidic device.

In some cases, if more than one fluidic unit is present, the fluidic units may be identical or at least substantially identical, e.g., disregarding orientation, rotations, reflections, translations, etc. The fluidic units can be positioned at any suitable repeat spacing, e.g., in embodiments where the fluidic units were identical or at least substantially identical. As a non-limiting example, in certain embodiments where an ANSI microwell plate used as a source of fluid, the fluidic units can be positioned at a repeat spacing of about 9 mm, about 4.5 mm, about 2.25 mm, or any other repeat spacing that is typically present in an ANSI microwell plate.

In one set of embodiments, a fluidic unit, such as a droplet-making unit, can comprise a plurality of channels, such as microfluidic channels, intersecting at an intersection. In some cases, some or all of the plurality of channels within a fluidic unit are substantially planar, e.g., such that there are no "bridges" or non-contacting crossings of one channel over another channel within the fluidic unit, and in some cases, the entire fluidic unit may be substantially planar.

As an example, in one set of embodiments, the fluidic unit may comprise a first channel holding a first fluid (e.g., a droplet fluid) and a second channel holding a second fluid (e.g., a carrier fluid) that intersect at an intersection. The intersection may also comprise an outlet channel that exits the intersection. Accordingly, as discussed herein, fluid within the first channel may interact with fluid within the second channel before exiting the intersection through the outlet channel. For example, the fluids may mix, react, from droplets, or the like Other configurations are also possible in other embodiments of the invention. For instance, there may be more than one channel that carries one or more fluids to an intersection (e.g., a carrier fluid and/or a droplet fluid), and/or there may be more than one outlet channel from the intersection. If more than one channel containing fluid is present, the channels may be in fluid communication with one, or more than one, source of fluid, e.g., a source of a first fluid (e.g., a droplet fluid) and/or source of a second fluid (e.g., a carrier fluid). As a non-limiting example, as shown in FIG. 1B, at intersection 130, channel 102 containing droplet fluid 105 intersects with channels 111 and 112, each of which contains carrier fluid 115. Droplet fluid 105 may arise from a source of droplet fluid that enters droplet-making unit 100 through inlet 108. In this figure, carrier fluid 115 in each of channels 111 and 112 is substantially identical, as each of these channels is in fluidic communication with channel 119, containing carrier fluid 115 (e.g., arising from a common source of carrier fluid) that enters droplet-making unit 100 through inlet 118. However, in other embodiments, there can be more than one fluid present, e.g., carried by different channels and/or arising from different inlets and/or sources of fluid (e.g., one or more sources of carrier fluid). In this figure, as fluids from channels 111 and 112 enter intersection 130, they cause fluid from channel 102 to break up into individual, discrete droplets 135, which exit intersection 130 through outlet channel 138 to outlet 139.

In certain embodiments, as discussed, a fluid unit may include an intersection where a first, droplet fluid interacts with a second, carrier fluid to form one or more droplets. The intersection of the droplet-making unit where the carrier fluid and the droplet fluid interact to form droplets can have any suitable configuration that allows droplets to be formed, and the droplets may be formed via any suitable mechanism. For example, the droplets may be formed by the creation of electric charges or dipole moments within the droplet fluid and/or the carrying fluid, the droplets may be created by altering the channel dimensions in a manner that is able to induce the fluid to form individual droplets, or the like. Other examples of suitable techniques include flow-focusing (e.g., under dripping and/or jetting conditions), mechanical techniques, and/or electrical techniques known to those of ordinary skill in the art. Further non-limiting examples of techniques useful for forming droplets at an intersection unit are disclosed in U.S. patent application Ser. No. 11/246,911, filed Oct. 7, 2005, entitled "Formation and Control of Fluidic Species," by Link, et al., published as U.S. Patent Application Publication No. 2006/0163385 on Jul. 27, 2006; U.S. Pat. No. 7,708,949, issued May 4, 2010, entitled "and Apparatus for Fluid Dispersion," by Stone, et al.; or U.S. patent application Ser. No. 11/360,845, filed Feb. 23, 2006, entitled "Electronic Control of Fluidic Species," by Link, et al., published as U.S. Patent Application Publication No. 2007/0003442 on Jan. 4, 2007, each incorporated herein by reference. In various embodiments, a plurality of droplets may be produced within a droplet-producing unit, e.g., as shown in FIG. 1B. In certain embodiments, the droplets thus formed may be monodisperse, e.g., as discussed herein.

As a non-limiting example, in accordance with one set of embodiments, a flow of droplet fluid may be compressed or "squeezed" by the introduction of one or more carrier fluids, e.g., using flow-focusing techniques. The carrier fluids can be at least substantially immiscible with the droplet fluid, which may cause the flow of droplet fluid to condense or "break up" to form individual or discrete droplets. In some, but not all embodiments, a dimensional restriction may be used to facilitate droplet formation, such as is disclosed in U.S. Pat. No. 7,708,949, issued May 4, 2010, entitled "and Apparatus for Fluid Dispersion," by Stone, et al. The dimensional restriction may have any suitable shape, e.g., an annular orifice. The dimensional restriction is non-valved in some embodiments; for example, the dimensional restriction may be an orifice that cannot be switched between an open state and a closed state, and is typically of fixed size. In other embodiments, however, no dimensional restriction is needed or necessary, e.g., as in the embodiment shown in FIG. 1B.

However, it should be understood that fluidic units need not be limited to only droplet-making units. In other embodiments, other actions may take place within one or more fluidic units, in addition or instead of forming droplets. As non-limiting example, two fluids may come together within a fluidic unit (e.g., in configurations such as those discussed herein, or in any other configuration where a first fluid entering the fluidic unit and a second fluid entering the fluidic unit are able to come into physical contact within the fluidic unit) and mix. The fluids may exhibit any degree of miscibility (e.g., ranging from miscible to immiscible). For example, a first fluid may be diluted with a second fluid (or vice versa) within a fluidic unit, or the first fluid and the second fluid may be at least partially immiscible and form different phases within the outlet channel (e.g., not necessarily by creating droplets). As yet another example, a reaction may occur when the first fluid and the second fluid come into contact; for instance, the first fluid may react with the second fluid, a species contained within the first fluid may react with the second fluid and/or another species contained within the second fluid, or the like.

Channels meeting at an intersection within a fluidic unit may meet any suitable angle. As shown in FIG. 1B, in some embodiments, the angles are right angles, although in other embodiments, other angles may be present. In one set of embodiments, a channel containing a first fluid intersects at an intersection with a channel containing a second fluid. The angle of intersection may be at about 90° or any other suitable angle. In some embodiments, the channels may meet at the intersection at about 180° from each other, or any other suitable angle relative to each other, for example, if more than one channel containing a second fluid (such as a carrier fluid) is present. The outlet channel of an intersection may be at an angle of about 90°, about 180°, or any other suitable angle with respect to any of the inlet channels entering the intersection. In some cases, the channels may meet at a T-junction, a Y-junction, an X-junction, or the like.

As mentioned, the channels intersecting at the intersection may be in fluidic communication with one or more inlets of the fluidic unit, which may, in turn, be in fluidic communication with one or more sources of fluid. In some embodiments of the invention, relatively long channels are used, e.g., between the inlet and an intersection where the fluids interact or droplets are created. Without wishing to be bound by any theory, longer channels may be useful in certain embodiments of the invention for example, to control the flow resistance between different fluidic units, e.g., such that the largest contribution of flow resistance between the different fluidic units is controlled by the length of the channels therein, and thus, by controlling the length of the channels, variability in flow resistance between different fluidic units may be reduced. In some cases, longer channels can be useful to reduce the ability of transient events (e.g., caused by the entry of fluid through inlets into the fluidic unit) to affect droplet production within the fluidic units.

Figure 2:
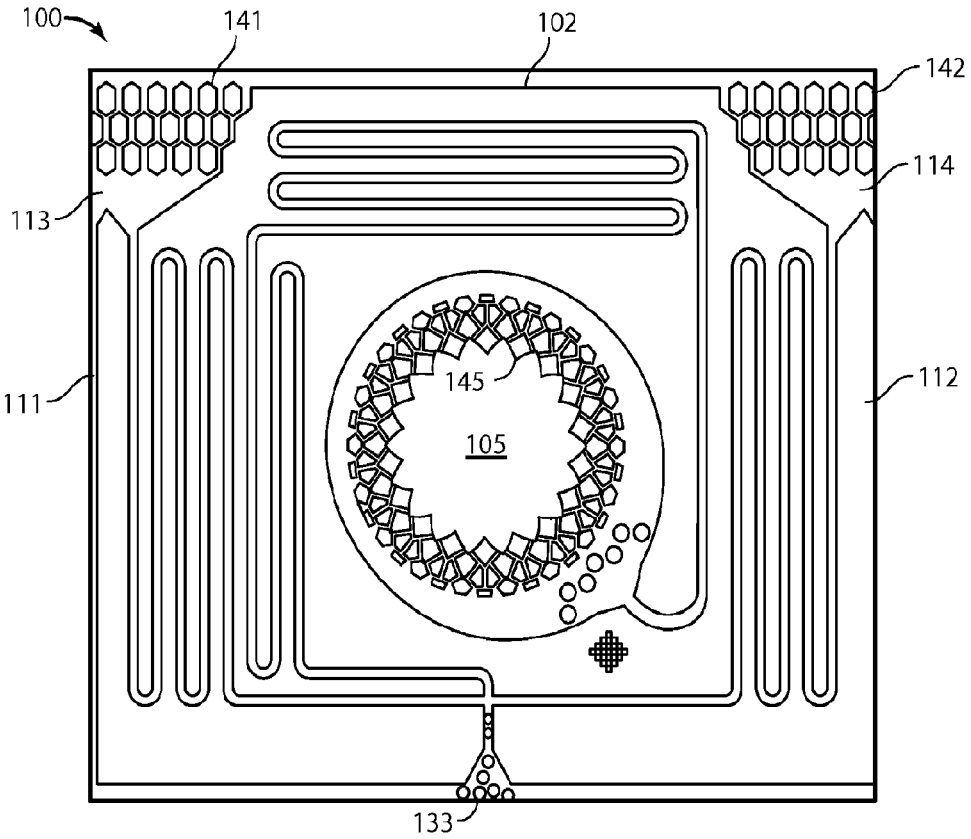
FIG. 2 illustrates a fluidic unit in another embodiment of the invention.

For example, in one set of embodiments, at least one channel within the fluidic unit (e.g., a droplet-making unit) may have a length that is greater than about two times the largest dimension of the fluidic unit, e.g., the longest straight line that can be completely contained within that fluidic unit. In certain instances, even longer channels may be present within the fluidic unit, e.g., greater than about 2.5, greater than about 3, greater than about 4, greater than about 5, greater than about 6, greater than about 8, or greater than about 10 times the largest dimension of the fluidic unit. Such channels may be present, in certain embodiments, by "winding" or "folding" the channel within the fluidic unit. For instance, a channel may have a serpentine flow pathway where the channel exhibits a first section and a second section that is substantially antiparallel (i.e., with respect to fluid flow) to the first section. In FIG. 2, for example, each of channels 102, 111, and 112 are folded in a serpentine flow pathway. For instance, channel 110 includes a first section exhibiting a downward portion (i.e., with respect to the page); a second, substantially antiparallel upward portion; a third, downward portion, etc. However, other directions of winding are also possible. As a specific example, channel 102 in this figure includes sections exhibiting leftward portions, rightward portions, upward portions, and downward portions (i.e., with respect to the page). In addition, it should be noted that a channel need not exhibit a serpentine flow pathway. For example, the channel may include a spiral portion, a randomly-directed portion, or any other suitable configuration. Also, other channels within the droplet-making unit need not have a length within the fluidic unit that is at least greater than two times the largest dimension of the fluidic unit.

The fluidic units may comprise one, two, three, or more inlets and/or outlets. For example, a fluidic unit may comprise a first inlet for introducing a first fluid into the fluidic unit and a second inlet for introducing a second fluid into the fluidic unit. In some cases, more than one inlet can be present in a fluidic unit. For example, as shown in FIG. 2, a fluidic unit 100, such as a droplet-making unit, may have two inlets for introducing a carrier fluid, e.g., inlets 113 and 114 fluidically are in fluidic communication with channels 111 and 112, respectively. As another example, there may be more than one inlet for introducing a droplet fluid into the fluidic unit. There may also be one or more than one outlet. In the example of FIG. 2, there is only one outlet 133 from the fluidic unit.

In one set of embodiments, an inlet of a fluidic unit may be substantially centrally positioned within the fluidic unit. For instance, the inlet can comprise the geometrical centroid of the fluidic unit. In certain embodiments, the substantially centrally positioned inlet is in fluid communication with a source of fluid, e.g., as is shown in FIG. 1B with inlet 105. The inlet is substantially circular in some embodiments. In some cases, the inlet may be in fluidic communication with a tube that is in fluidic communication with a source of fluid. For example, the source of fluid may be positioned externally of the microfluidic device, and the tube may be used to deliver fluid from the source of fluid to the inlet of the fluidic unit. For instance, the source of fluid may be a source of droplet fluid in an embodiment where droplets are produced in a fluidic unit.

In some embodiments, the tube may fluidically connect a source of fluid to an inlet of a fluidic unit. The tube may not necessarily be an integral part of the microfluidic device, and instead may extend outwardly from the droplet-making unit or the microfluidic device. The tube itself is not necessarily microfluidic, although it can be in some instances. In one set of embodiments, for example, the tube may be relatively large. The tube can be formed out of any suitable material, for example, polymers such as polyethylene (PE), polypropylene (PP), polyether ether ketone (PEEK), fluorinated ethylene propylene (FEP), etc.; glass, or steel (e.g., a hypodermic tube). In embodiments with more than one fluidic unit, there may be a plurality of such tubes. In some embodiments, substantially each of the tubes fluidically connects one of the different sources of fluid to the one of the fluidic units. In some cases, at least some tubes of the plurality of tubes are substantially parallel to each other. For example, the tubes may be arranged in an array, each extending outwardly from the plurality of fluidic units, such that the tubes can be inserted or otherwise interfaced with different sources of fluid. In such a way, different fluids may be introduced to the plurality of fluidic units through the array of tubes. In other embodiments, however, more than one tube may be used to fluidically connect to a given source of fluid. Thus, for example, one source of fluid may be in fluidic communication with two, three, four, etc. tubes that in turn are in fluidic communication with two, three, four, etc. fluidic units.

In some embodiments, a microfluidic device can comprise one or more filters. The filters can be used in some cases to at least partially aid in removing at least a portion of any unwanted particulates from a fluid entering the device. In some cases, the filters are formed integrally within the microfluidic device, or within the fluidic unit in some embodiments. For example, the filters may be positioned at an inlet of the microfluidic device, and/or at an inlet of a fluidic unit. In some cases, there may be more than one filter present within the microfluidic device. For instance, substantially each of the fluidic units can contain one or more filters.

Non-limiting examples of such filters may be seen in FIG. 2 with filters 141, 142, and 145 proximate to inlets 113, 114, and 105, respectively. The filters can be used to remove particulate matter (e.g., dust, particles, dirt, debris, cell remnants, protein aggregates, liposomes, colloidal particles, insoluble materials, other unidentified particulates, etc.), which may otherwise cause clogging or blockage of a channel. The particulates may be present in a fluid passing through a filter. For instance, particulates may become lodged within the filter and be prevented from passing therethrough. It should be noted that even if some particulates are present and block some passages within the filter, the filter may still be effective at passing fluid therethrough and filtering additional particulates as long as some passages exist through the filter for fluid to flow.

A microfluidic filter can comprise a plurality of posts in some embodiments. The posts may be arranged in any suitable configuration. For example, the posts may be positioned at or near an inlet. The posts may be of any suitable size, shape, and/or number, and be positioned in any suitable arrangement within the filter. If more than one post is present, the posts may independently be of the same, or different, shape and/or size. The size of the gaps between the posts can be selected such that the size of each gap is about 1%, about 2%, about 3%, about 5%, about 10%, about 15%, about 20%, about 30%, about 40%, about 50%, about 60%, about 70%, about 80%, or about 90% of the size of the filter, or the size of a cross-section distance of a channel in which the fluid may flow through following exiting the filter.

Non-limiting examples of shapes for posts include, but are not limited to, rectangle, square, circle, oval, trapezoid, teardrop, triangle, etc. In some embodiments, the length of a post may be substantially greater than the width of the post, or the width of a post may be substantially greater than the length of the post. The filter can comprise about 5, about 6, about 7, about 8, about 9, about 10, about 11, about 12, about 15, about 20, or more, posts. The posts may be arranged in a linear arrangement and/or in other arrangements, including multiple lines of posts (rectangularly arrayed, staggered, etc.) or randomly arrangements of posts. In some cases, the posts may be associated with any suitable surface of the channel (e.g., bottom, top, and/or walls of the channel). In some cases, the posts may be arranged in a three-dimensional arrangement. In some cases, the height of the microfluidic channel may vary and/or the height of the posts may vary.

The fluidic units (e.g., droplet-making units) can be contained within a microfluidic device, which may contain one or more layers, some or all of which may define the fluidic units, in accordance with certain aspects of the invention. For instance, the microfluidic device may have channels positioned at different heights, having multiple heights, etc. If more than one layer is used, the layers may be assembled or bonded together, e.g., using plasma bonding or other suitable techniques, to produce the microfluidic device. In some embodiments, one or more of the layers may have one or more mating protrusions and/or indentations which are aligned to properly align the layers, e.g., in a lock-and-key fashion. For example, a first layer may have a protrusion (having any suitable shape) and a second layer may have a corresponding indentation which can receive the protrusion, thereby causing the two layers to become properly aligned with respect to each other.

As a non-limiting example of a microfluidic device formed from multiple layers, as is shown in FIG. 3, a device comprising 96 substantially identical droplet-making units is illustrated. It should be noted that droplet-making units are shown in FIG. 3 by way of example only, and in other embodiments, other fluidic units may be used, e.g., instead of and/or in addition to droplet-making units. In this example, half of the substantially identical droplet-making units have the configuration of the droplet-making unit shown in FIG. 2, while the other half have a configuration that is essentially a mirror image of this droplet-making unit. This configuration allows two adjacent droplet-making units, having mirror image configurations relative to each other, to share incoming carrier fluid. It should be noted, however, that the invention is not limited to only devices having droplet-making units with mirror image configurations, as this figure is by way of example only. For example, in various embodiments, all of the droplet-making units may be identical, or there may be any number or type of rotations, reflections, translations, etc. present. In some cases, there may also be droplet-making units having substantially different configurations, e.g., as discussed herein.

In some embodiments, there can be one or more channels within a microfluidic device, some or all of which may be substantially parallel in certain cases, for distributing a fluid (e.g., from a common source of fluid) to substantially each of the droplet-making units, and/or for collecting droplets or other product (e.g., mixtures, reaction products, etc.) arising from substantially each of the fluidic units. In some cases, the channels may include microfluidic channels.

Figure 3A:
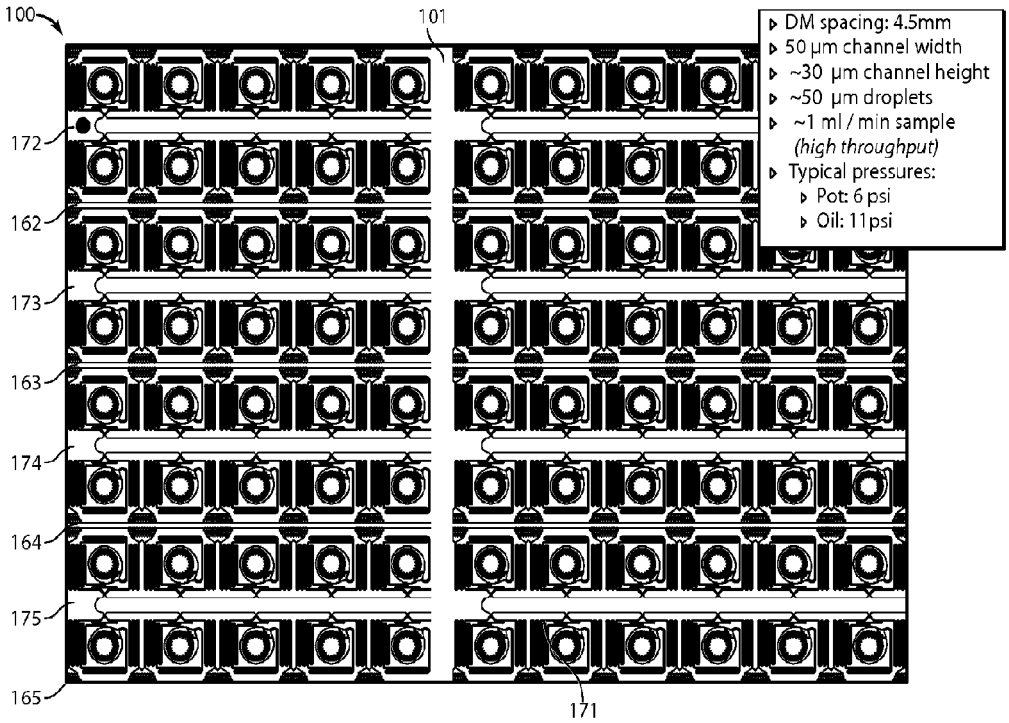
FIGS. 3A-3B illustrate microfluidic devices comprising a plurality of droplet-making units, in yet other embodiments of the invention.

As a non-limiting example, in FIG. 3A, a carrier fluid can enter microfluidic device 100 through channel 161 to be distributed by substantially parallel channels 162, 163, 164, and 165. As noted above, FIG. 3 illustrates droplet-making units by way of example only. From each of these channels, the carrier fluid may pass into one of a number of droplet-making units positioned on either side of each of these channels. In addition, shown in FIG. 3 are substantially parallel channels 172, 173, 174, and 175 for collecting droplets produced by the droplet-making units. Droplets collected in these channels flows to a common channel 171, which then exits microfluidic device 100, e.g., thereby producing a library of droplets, or for other uses such as those described herein.

Figure 3B:
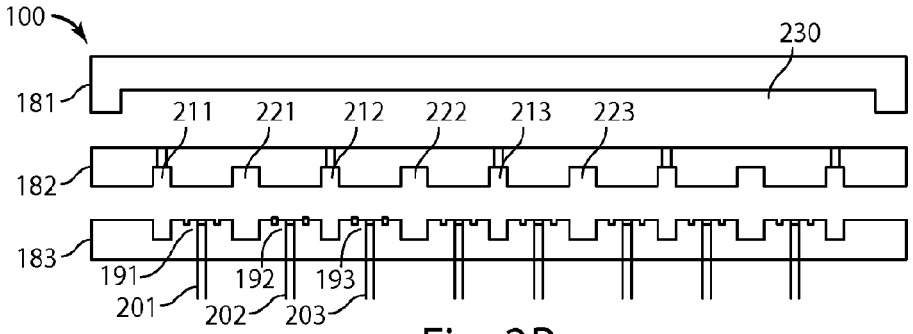

A schematic side view of this device is shown in FIG. 3B. As shown here, microfluidic device 100 includes three layers 181, 182, and 183. The device includes a number of droplet-making units 191, 192, 193, etc. defined between layers 182 and 183, each of which is connected to tubes 201, 202, 203, etc. exiting device 100. Defined between the droplet-making units are channels 211, 212, 213, etc. which can carry carrier fluid to the droplet-making units, and channels 221, 222, 223, etc. which can carry droplets produced by the droplet-making units. Channel 230 defined between layers 181 and 182 may be used to move carrier fluid to each of channels 211, 212, 213, etc. (as shown), or carry droplets away from the droplet-making units (not shown).

Figure 4A:
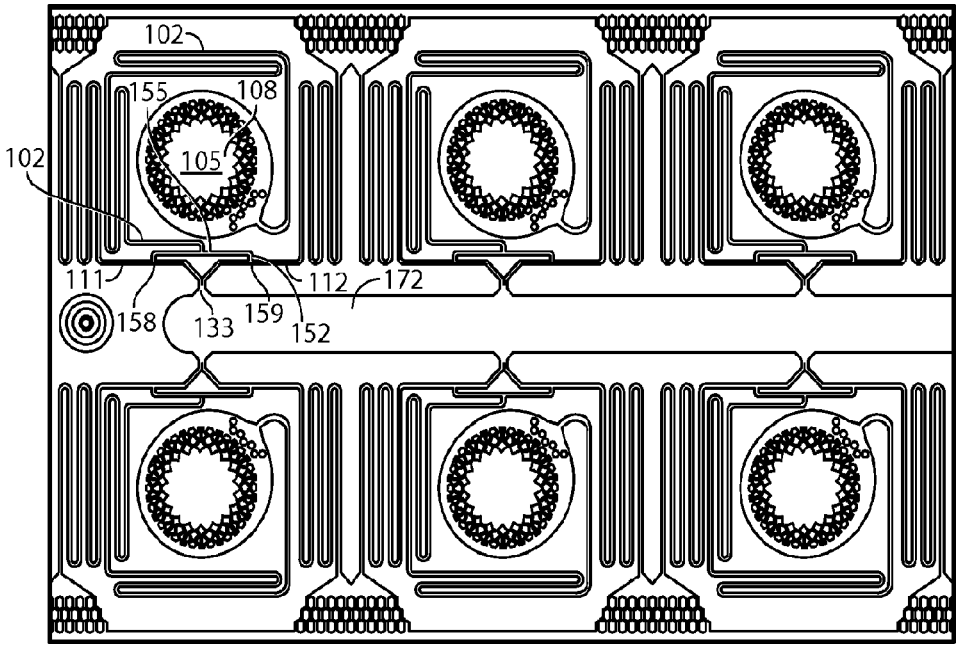
FIGS. 4A-4B illustrate additional droplet-making units, in accordance with another embodiment of the invention.
Figure 4B:
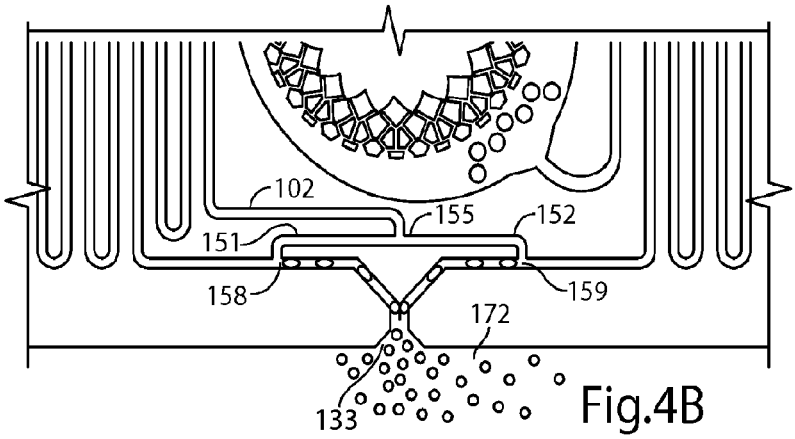

Another configuration is shown in FIG. 4. In FIG. 4A, fluid 105 entering inlet 108 flows through channel 102 to T-junction 155, which splits into channels 151 and 152. Each of channels 151 and 152 then intersect with channels 111 and 112, respectively, at junctions 158 and 159. Channels 111 and 112 carry a carrier fluid, which may arise from one or more than one source. FIG. 4B is an expanded view of FIG. 4A. As shown in FIG. 4B, two sets of droplets are created at the junctions of channels 111 and 151, and channels 112 and 152. The droplets may exit via one or more outlets 133 into a collection channel 172. Such a configuration may be useful, for example, to provide redundancy in regard to channel blockage, or to increase the droplet production rate. In addition, it should be noted that in other embodiments of the invention, other configurations may be used, e.g., having additional junctions for creating droplets within a droplet-making unit.

Certain aspects of the invention involve the use of one or more fluids. As mentioned, the term "fluid" generally refers to a substance that tends to flow and to conform to the outline of its container, i.e., a liquid, a gas, a viscoelastic fluid, etc. Typically, fluids are materials that are unable to withstand a static shear stress, and when a shear stress is applied, the fluid experiences a continuing and permanent distortion. The fluid may have any suitable viscosity that permits flow. If two or more fluids are present, each fluid may be independently selected among essentially any fluids (liquids, gases, and the like) by those of ordinary skill in the art, by considering the relationship between the fluids.

In some cases, two or more fluids may be used. As noted, the fluids may be may exhibit any degree of miscibility, e.g., ranging from miscible to immiscible. In some cases, the two fluids may be at least substantially immiscible. For example, as previously discussed, in one set of embodiments, the carrier fluid may be an oil (or the carrier fluid may be substantially immiscible in water), while the droplet fluid may be hydrophilic (or the droplet fluid may be substantially miscible in water). In other embodiments, however, the carrier fluid may be hydrophilic while the droplet fluids may be hydrophobic, or substantially immiscible in water. As used herein, two fluids are immiscible, or not miscible, with each other when one is not soluble in the other to a level of at least 10% by weight at the temperature and under the conditions at which the droplets are produced. In one embodiment, two fluids may be selected to be immiscible within the time frame of the formation of the droplets.

It should be noted that the term "oil" as used herein merely refers to a fluid that is generally more hydrophobic than water and is substantially immiscible in water, as is known in the art. Thus, the oil may comprise a hydrocarbon in some embodiments, but in other embodiments, the oil may comprise other hydrophobic fluids. Non-limiting examples of hydrophobic liquids include, but are not limited to, a silicone oil, a mineral oil, a fluorocarbon oil (e.g., octadecafluorodecahydronaphthalene or 1-(1,2,2,3,3,4,4,5,5,6,6-undecafluorocyclohexyl)ethanol), a hydrocarbon oil (e.g., hexadecane), an organic solvent, or the like.

A hydrophilic liquid is a liquid that is typically substantially water soluble, at least under certain conditions, e.g., ambient conditions (1 atm at 25° C.). Examples of hydrophilic liquids include, but are not limited to, water and other aqueous solutions comprising water, such as cell or biological media, saline solutions, etc., as well as other hydrophilic liquids such as ethanol, dimethylsulfoxide (DMSO), etc.

Additional non-limiting examples include a salt solution, a buffer solution, a suspension of water containing particles, or the like.

A fluid (e.g., carrier fluid or droplet fluid) may be delivered from a source of fluid to the microfluidic device using any suitable mechanism. For example, a pump, gravity, capillary action, surface tension, electroosmosis, centrifugal forces, vacuum or pressures below atmospheric pressure, etc. may be used to deliver a fluid from a fluid source into one or more channels in the device. Non-limiting examples of pumps include syringe pumps, peristaltic pumps, pressurized fluid sources, or the like. In some aspects, fluid from the different sources of fluid may be delivered to the fluidic units by applying substantially the same pressure and/or pressure drop (e.g., measured from the source of pressure to an outlet or a collector channel exiting the device) to substantially all of the different sources of fluid to cause the fluids to move from the different sources of fluid into the microfluidic device. For example, with respect to droplet-making units, fluid from different sources of droplet fluid may be delivered to the droplet-making units by applying substantially the same pressure and/or pressure drop to substantially all of the different sources of droplet fluid.

The pressure may be applied directly to substantially all of the different sources of fluid, for example, using a syringe, a piston, or other mechanical device, and/or by applying a pressurizing fluid to substantially all of the different sources of fluid. The pressure that is applied may be a constant pressure, a constant pressure drop (e.g., from a pressure source to an outlet of the device), and/or a pressure that is controlled such that the flow rate of fluid into the deice remains substantially constant. The pressure may also be greater than atmospheric pressure, or less than atmospheric pressure (e.g., a vacuum) in some embodiments. For example, a first pressure may be applied to substantially all of the different sources of fluid, and/or a second pressure may be applied at an outlet of the device to urge fluid movement within the device. The first pressure is typically greater than the second pressure. In various embodiments, the first pressure and the second pressure may each be greater than atmospheric pressure, each less than atmospheric pressure, one may be greater than and one less than atmospheric pressure, one may be at atmospheric pressure and the other at a greater or lesser pressure, or the like.

In some embodiments, the different sources of fluid may be open to a common environment containing a common pressurizing fluid, for instance, air or water. The pressurizing fluid may be chosen to be able to remain substantially separate from the fluid within the different sources of fluid. In one set of embodiments, the pressurizing fluid may be a fluid in a different phase (e.g., a gas such as air, nitrogen, $CO_2$, etc., for example, if the fluids within the different sources of fluid are liquid), and/or the pressurizing fluid may be chosen to be one that is substantially immiscible with the fluid within the different sources of fluid, e.g., if the fluids are both liquids. For example, if the fluids within the different sources of fluid are aqueous, an oil that is substantially immiscible with the aqueous fluids may be used. Examples of oils that are substantially immiscible with aqueous fluids, and that can be used accordingly, are discussed herein. In some embodiments, the pressurizing fluid may be substantially the same as the carrying fluid used to carry droplets produced within droplet-making units, although in other embodiments, the fluids may not be substantially the same.

A non-limiting example of such a system is now discussed, referring again to FIG. 1. In this figure, a plurality of sources of droplet fluid 21, 22, 23, 24, and 25, each containing droplet fluid 31, 32, 33, 34, and 35, is shown. Again, five sources are shown in this figure by way of example only, and other numbers of sources of droplet fluid may be present in other embodiments. Each of these sources of droplet fluid may be open to a common environment 15. Common environment 15, in certain embodiments, can contain a gas such as air, argon, nitrogen, $CO_2$, etc. For example, microfluidic system 10 may be contained within a pressure chamber, which contains common environment 15. The pressure chamber may be chosen so as to be able to substantially retain a pressure therein, e.g., a pressure that is greater than or less than atmospheric pressure. The pressure in the pressure chamber may be controlled, for example, using a pressure regulator, a pump, or other suitable pressure source able to alter pressure. Many such pressure sources and pressure chambers are commercially available. By controlling the pressure of common environment 15, which acts on each of the plurality of sources of droplet fluid 21, 22, 23, 24, and 25, the pressure acting on each of these plurality of sources of droplet fluid may be controlled, e.g., such that the pressure applied to substantially all of the different sources of droplet fluid is substantially the same.

In certain embodiments, the pressure used to deliver a second fluid (e.g., a carrier fluid) from a source of the second fluid into the microfluidic device may be the same or different than the pressure used to deliver fluid from the different sources of fluid discussed above. In some cases, the pressure used to deliver the second fluid may be controlled independently of the pressure used to deliver the other fluids. The same or different mechanisms may be used to control the pressure of substantially each fluid. For example, the pressure used to deliver the second fluid may be applied or controlled using a syringe, a piston, or other mechanical device, by applying a pressurizing fluid to the second fluid, or the like.

In some cases, the pressure to any one or more of these sources (e.g., to the second fluid and/or one or more of the different sources of first fluid) may be controlled based on the plurality of droplets produced within the microfluidic device. For example, if droplets produced within droplet-making units within a microfluidic device are too large or too small, if too many or too few droplets are being produced, if too many or too few of a certain type of droplet are being produced, the relevant pressures may be altered accordingly to correct the problem. As other examples, the pressure may be controlled based on the relative amounts of fluid (e.g., first and second fluids) that are produced within fluidic units, the amount or degree of reaction occurring within the fluidic units, etc. Any suitable technique may be used to determine such fluids, e.g., fluorescence imaging, microscopy (e.g., light microscopy), laser light scattering, or the like.

In certain aspects of the invention, one or more fluids (e.g., first and/or second fluids entering a fluidic unit) may contain additional entities or species, for example, other chemical, biochemical, or biological entities (e.g., dissolved or suspended in the fluid), cells, particles, gases, molecules, pharmaceutical agents, drugs, DNA, RNA, proteins, fragrance, reactive agents, biocides, fungicides, preservatives, chemicals, or the like. For example, one or more cells and/or one or more cell types can be contained within a fluid, e.g., for encapsulation within a droplet, for reaction with another species, etc.

In certain aspects of the invention, a set of droplets may be produced within the microfluidic device. The set of droplets, may comprise some or all of the droplets produced within the microfluidic device. For example, at least about 30%, at least about 40%, at least about 50%, at least about 60%, at least about 70%, at least about 80%, at least about 90%, or about 100% of the droplets produced within the microfluidic device may from a set of droplets. In some cases, the set of droplets may have a certain or particular characteristic, e.g., being monodisperse, comprising droplet fluid from the same or different sources of droplet fluid, contain different species and/or the same species at different concentrations, etc. In some cases, there may be other droplets present, not part of the set, having different characteristics. In other embodiments however, there may be no such droplets present and all droplets produced within the microfluidic device from the set of droplets.

For example, in some aspects of the invention, a monodisperse set of droplets may be produced, e.g., in one or more droplet-making units. The shape and/or size of the fluidic droplets can be determined, for example, by measuring the average diameter or other characteristic dimension of the droplets. The "average diameter" of a plurality or series of droplets is the arithmetic average of the average diameters of each of the droplets. Those of ordinary skill in the art will be able to determine the average diameter (or other characteristic dimension) of a plurality or series of droplets, for example, using laser light scattering, microscopic examination, or other known techniques. The average diameter of a single droplet, in a non-spherical droplet, is the diameter of a perfect sphere having the same volume as the non-spherical droplet. The average diameter of a droplet (and/or of a plurality or series of droplets) may be, for example, less than about 1 mm, less than about 500 micrometers, less than about 200 micrometers, less than about 100 micrometers, less than about 75 micrometers, less than about 50 micrometers, less than about 25 micrometers, less than about 10 micrometers, or less than about 5 micrometers in some cases. The average diameter may also be at least about 1 micrometer, at least about 2 micrometers, at least about 3 micrometers, at least about 5 micrometers, at least about 10 micrometers, at least about 15 micrometers, or at least about 20 micrometers in certain cases.

In some embodiments, the monodisperse set of droplets may have an overall average diameter and a distribution of diameters such that no more than about 5%, no more than about 2%, or no more than about 1% of the particles have a diameter less than about 90% (or less than about 95%, or less than about 99%) and/or greater than about 110% (or greater than about 105%, or greater than about 101%) of the overall average diameter of the plurality of particles. In some embodiments, the plurality of droplets may have an overall average diameter and a distribution of diameters such that the coefficient of variation of the cross-sectional diameters of the droplets is less than about 10%, less than about 5%, less than about 2%, between about 1% and about 10%, between about 1% and about 5%, or between about 1% and about 2%. The coefficient of variation can be determined by those of ordinary skill in the art, and may be defined as the standard deviation divided by the mean.

In some embodiments, droplets may be produced within the device at relatively high rates. For example, the droplet production within the device of a single droplet making unit may be between approximately 100 Hz and 5,000 Hz (droplets/second). In some cases, the rate of droplet production may be at least about 100 Hz, at least about 200 Hz, at least about 300 Hz, at least about 500 Hz, at least about 750 Hz, at least about 1,000 Hz, at least about 2,000 Hz, at least about 3,000 Hz, at least about 4,000 Hz, at least about 5,000 Hz, at least about 7,500 Hz, at least about 10,000 Hz, etc. The overall rate of droplet production within the device, in some embodiments, would be equal to these rates multiplied by the number of droplet-making units present (e.g., 6, 24, 96, 384, or 1,536, etc.).

In some embodiments, the volume of droplets produced in the device may be relatively high. For example, the volumetric rate of droplet production may be at least about 1 ml of droplets per second (i.e., determined the total volume of all of the droplets produced within the microfluidic device, on a per-second basis), and in some cases, the volumetric rate of droplet production may be at least about 2 ml of droplets per second, at least about 3 ml of droplets per second, at least about 5 ml of droplets per second, at least about 10 ml of droplets per second, at least about 20 ml of droplets per second, at least about 30 ml of droplets per second, at least about 50 ml of droplets per second, etc. The droplets may be produced under "dripping" or "jetting" conditions, according to certain embodiments of the invention.

In addition, higher rates or production of larger quantities of droplets can be facilitated by the parallel use of multiple devices in some instances. For example, in some cases, relatively large numbers of devices such as the ones described herein may be used in parallel, for example at least about 10 devices, at least about 30 devices, at least about 50 devices, at least about 75 devices, at least about 100 devices, at least about 200 devices, at least about 300 devices, at least about 500 devices, at least about 750 devices, or at least about 1,000 devices or more may be operated in parallel. In certain instances, the devices may comprise different channels, orifices, microfluidics, etc. The devices may be commonly controlled, or separately controlled, and can be provided with common or separate sources of fluids, depending on the application. Examples of such systems are also described in Int. Patent Application Serial No. PCT/US2010/000753, filed Mar. 12, 2010, entitled "Scale-up of Microfluidic Devices," by Romanowsky, et al., published as WO 2010/104597 on Sep. 16, 2010, incorporated herein by reference.

As fluid viscosity can affect droplet formation, in some cases the viscosity of any of the fluids in the fluidic droplets may be adjusted by adding or removing components, such as diluents, that can aid in adjusting viscosity. For example, in some embodiments, the viscosity of the droplet fluid and the carrying fluid are equal or substantially equal. In other embodiments, the carrying fluid may exhibit a viscosity that is substantially different from the droplet fluid. A substantial difference in viscosity means that the difference in viscosity between the two fluids can be measured on a statistically significant basis.

The droplets may be used for any suitable application, in various aspects. For example, using the methods and devices described herein, in some embodiments, a set of droplets having consistently sized droplets and/or concentrations of droplets can be produced. In some embodiments, for instance, a population of droplets containing various species may be created. In certain cases, a single droplet can be used to provide a specific quantity of a drug. In addition, combinations of compounds or drugs may be stored, transported, or delivered in a droplet. Thus, in some embodiments, a plurality of droplets, some or all of which contain compounds, drugs, and/or other species, may be produced.

In another set of embodiments, the droplets produced within the device may be used to define a library. A library may contain droplets that are all substantially the same size (or different sizes, in some cases). In some embodiments, the droplets can have substantially the same composition (for example, the same solvent), but differ in the species contained within the droplets. Other non-limiting examples of libraries have been previously discussed herein. For instance, a first member of a library may include droplets containing a first species, and a second member of a library may include droplets containing a second species, the first species at a different concentration, a first species and a second species, etc. Such libraries may be useful, for example, for various applications, such as nucleic acid sequencing applications, screening assays, high-throughput screening, or the like. In some embodiments, the composition may comprise at least about 5, at least about 8, at least about 10, at least about 20, at least about 50, at least about 64, at least about 100, at least about 128, at least about 200, at least about 500, at least about 1000, at least about 4096, at least about 10,000, at least about 50,000, etc. mutually distinguishable species. As non-limiting examples, the library may contain, as species, various proteins, nucleic acids, cells, enzymes, antibodies, drugs, pharmaceutical agents, etc. Other examples of species are discussed herein.

In some embodiments, as non-limiting examples, the library can comprise every possible sequence for a set of nucleic acid sequences having a certain length or lengths. In another embodiment, the library may comprise at least about 30%, at least about 50%, at least about 80%, at least about 85%, at least about 90%, at least about 95%, or at least about 100% of all possible sequences having a certain length or lengths.

Certain aspects of the invention are generally directed to devices containing channels such as those described above. In some cases, some or all of the channels may be microfluidic channels. There can be any number of channels, including microfluidic channels, within the device, and the channels may be arranged in any suitable configuration. The channels may be all interconnected, or there can be more than one network of channels present. The channels may independently be straight, curved, bent, etc. In some cases, there may be a relatively large number and/or a relatively large length of channels present in the device. For example, in some embodiments, the channels within a device, when added together, can have a total length of at least about 100 micrometers, at least about 300 micrometers, at least about 500 micrometers, at least about 1 mm, at least about 3 mm, at least about 5 mm, at least about 10 mm, at least about 30 mm, at least 50 mm, at least about 100 mm, at least about 300 mm, at least about 500 mm, at least about 1 m, at least about 2 m, or at least about 3 m in some cases. As another example, a device can have at least 1 channel, at least 3 channels, at least 5 channels, at least 10 channels, at least 20 channels, at least 30 channels, at least 40 channels, at least 50 channels, at least 70 channels, at least 100 channels, etc.

In some embodiments, at least some of the channels within the device are microfluidic channels. "Microfluidic device," as used herein, refers to a device including at least one fluid channel having a cross-sectional dimension of less than about 1 mm, i.e., a microfluidic channel. The "cross-sectional dimension" of the channel is measured perpendicular to the direction of net fluid flow within the channel. Thus, for example, some or all of the fluid channels in a device can have a maximum cross-sectional dimension less than about 2 mm, and in certain cases, less than about 1 mm. In one set of embodiments, all fluid channels in a device are microfluidic and/or have a largest cross sectional dimension of no more than about 2 mm or about 1 mm. In certain embodiments, the fluid channels may be formed in part by a single component (e.g. an etched substrate or molded unit), e.g., as part of a layer within the device. Of course, larger channels, tubes, chambers, reservoirs, etc. can be used to store fluids and/or deliver fluids to various elements or systems in other embodiments of the invention.

A channel within the device can have any cross-sectional shape (circular, oval, triangular, irregular, square or rectangular, or the like) and can be covered or uncovered. In embodiments where it is completely covered, at least one portion of the channel can have a cross-section that is completely enclosed, or the entire channel may be completely enclosed along its entire length with the exception of its inlets and/or outlets or openings. A channel may also have an aspect ratio (length to average cross sectional dimension) of at least 2:1, more typically at least 3:1, 4:1, 5:1, 6:1, 8:1, 10:1, 15:1, 20:1, or more. An open channel generally will include characteristics that facilitate control over fluid transport, e.g., structural characteristics (an elongated indentation) and/or physical or chemical characteristics (hydrophobicity vs. hydrophilicity) or other characteristics that can exert a force (e.g., a containing force) on a fluid. The fluid within the channel may partially or completely fill the channel. In some cases where an open channel is used, the fluid may be held within the channel, for example, using surface tension (i.e., a concave or convex meniscus).

The channel may be of any size, for example, having a largest dimension perpendicular to net fluid flow of less than about 5 mm or 2 mm, or less than about 1 mm, less than about 500 microns, less than about 200 microns, less than about 100 microns, less than about 60 microns, less than about 50 microns, less than about 40 microns, less than about 30 microns, less than about 25 microns, less than about 10 microns, less than about 3 microns, less than about 1 micron, less than about 300 nm, less than about 100 nm, less than about 30 nm, or less than about 10 nm. In some cases, the dimensions of the channel are chosen such that fluid is able to freely flow through the device or substrate. The dimensions of the channel may also be chosen, for example, to allow a certain volumetric or linear flow rate of fluid in the channel. Of course, the number of channels and the shape of the channels can be varied by any method known to those of ordinary skill in the art. In some cases, more than one channel may be used. For example, two or more channels may be used, where they are positioned adjacent or proximate to each other, positioned to intersect with each other, etc.

In certain embodiments, one or more of the channels within the device may have an average cross-sectional dimension of less than about 10 cm. In certain instances, the average cross-sectional dimension of the channel is less than about 5 cm, less than about 3 cm, less than about 1 cm, less than about 5 mm, less than about 3 mm, less than about 1 mm, less than 500 micrometers, less than 200 micrometers, less than 100 micrometers, less than 50 micrometers, or less than 25 micrometers. The "average cross-sectional dimension" is measured in a plane perpendicular to net fluid flow within the channel. If the channel is non-circular, the average cross-sectional dimension may be taken as the diameter of a circle having the same area as the cross-sectional area of the channel. Thus, the channel may have any suitable cross-sectional shape, for example, circular, oval, triangular, irregular, square, rectangular, quadrilateral, or the like. In some embodiments, the channels are sized so as to allow laminar flow of one or more fluids contained within the channel to occur.

The channel may also have any suitable cross-sectional aspect ratio. The "cross-sectional aspect ratio" is, for the cross-sectional shape of a channel, the largest possible ratio (large to small) of two measurements made orthogonal to each other on the cross-sectional shape. For example, the channel may have a cross-sectional aspect ratio of less than about 2:1, less than about 1.5:1, or in some cases about 1:1 (e.g., for a circular or a square cross-sectional shape). In other embodiments, the cross-sectional aspect ratio may be relatively large. For example, the cross-sectional aspect ratio may be at least about 2:1, at least about 3:1, at least about 4:1, at least about 5:1, at least about 6:1, at least about 7:1, at least about 8:1, at least about 10:1, at least about 12:1, at least about 15:1, or at least about 20:1.

As mentioned, the channels can be arranged in any suitable configuration within the device. Different channel arrangements may be used, for example, to manipulate fluids, droplets, and/or other species within the channels. For example, channels within the device can be arranged to create droplets (e.g., discrete droplets, single emulsions, double emulsions or other multiple emulsions, etc.), to mix fluids and/or droplets or other species contained therein, to screen or sort fluids and/or droplets or other species contained therein, to split or divide fluids and/or droplets, to cause a reaction to occur (e.g., between two fluids, between a species carried by a first fluid and a second fluid, or between two species carried by two fluids to occur), or the like.

Non-limiting examples of systems for manipulating fluids, droplets, and/or other species are discussed below. Additional examples of suitable manipulation systems can also be seen in U.S. patent application Ser. No. 11/246,911, filed Oct. 7, 2005, entitled "Formation and Control of Fluidic Species," by Link, et al., published as U.S. Patent Application Publication No. 2006/0163385 on Jul. 27, 2006; U.S. patent application Ser. No. 11/024,228, filed Dec. 28, 2004, entitled "Method and Apparatus for Fluid Dispersion," by Stone, et al., now U.S. Pat. No. 7,708,949, issued May 4, 2010; U.S. patent application Ser. No. 11/885,306, filed Aug. 29, 2007, entitled "Method and Apparatus for Forming Multiple Emulsions," by Weitz, et al., published as U.S. Patent Application Publication No. 2009/0131543 on May 21, 2009; and U.S. patent application Ser. No. 11/360,845, filed Feb. 23, 2006, entitled "Electronic Control of Fluidic Species," by Link, et al., published as U.S. Patent Application Publication No. 2007/0003442 on Jan. 4, 2007; each of which is incorporated herein by reference in its entirety. As non-limiting examples, one or more fluids in the microfluidic device may be combined with other fluids (e.g., containing reagents, species, etc.), diluted, reacted, etc., e.g., before and/or after the formation of droplets.

A variety of materials and methods, according to certain aspects of the invention, can be used to form devices or components such as those described herein, e.g., channels such as microfluidic channels, chambers, etc. For example, various devices or components can be formed from solid materials, in which the channels can be formed via micromachining, film deposition processes such as spin coating and chemical vapor deposition, laser fabrication, photolithographic techniques, etching methods including wet chemical or plasma processes, and the like. See, for example, *Scientific American,* 248:44-55, 1983 (Angell, et al).

In one set of embodiments, various structures or components of the devices described herein can be formed of a polymer, for example, an elastomeric polymer such as polydimethylsiloxane ("PDMS"), polytetrafluoroethylene ("PTFE" or Teflon®), or the like. For instance, according to one embodiment, a microfluidic channel may be implemented by fabricating the fluidic system separately using PDMS or other soft lithography techniques (details of soft lithography techniques suitable for this embodiment are discussed in the references entitled "Soft Lithography," by Younan Xia and George M. Whitesides, published in the *Annual Review of Material Science,* 1998, Vol. 28, pages 153-184, and "Soft Lithography in Biology and Biochemistry," by George M. Whitesides, Emanuele Ostuni, Shuichi Takayama, Xingyu Jiang and Donald E. Ingber, published in the *Annual Review of Biomedical Engineering,* 2001, Vol. 3, pages 335-373; each of these references is incorporated herein by reference).

Other examples of potentially suitable polymers include, but are not limited to, polyethylene terephthalate (PET), polyacrylate, polymethacrylate, polycarbonate, polystyrene, polyethylene, polypropylene, polyvinylchloride, cyclic olefin copolymer (COC), polytetrafluoroethylene, a fluorinated polymer, a silicone such as polydimethylsiloxane, polyvinylidene chloride, bis-benzocyclobutene ("BCB"), a polyimide, a fluorinated derivative of a polyimide, or the like. Combinations, copolymers, or blends involving polymers including those described above are also envisioned. The device may also be formed from composite materials, for example, a composite of a polymer and a semiconductor material.

In some embodiments, various structures or components of the device are fabricated from polymeric and/or flexible and/or elastomeric materials, and can be conveniently formed of a hardenable fluid, facilitating fabrication via molding (e.g. replica molding, injection molding, cast molding, hot embossing, etc.). The hardenable fluid can be essentially any fluid that can be induced to solidify, or that spontaneously solidifies, into a solid capable of containing and/or transporting fluids contemplated for use in and with the fluidic network. In one embodiment, the hardenable fluid comprises a polymeric liquid or a liquid polymeric precursor (i.e. a "prepolymer"). Suitable polymeric liquids can include, for example, thermoplastic polymers, thermoset polymers, waxes, metals, or mixtures or composites thereof heated above their melting point. As another example, a suitable polymeric liquid may include a solution of one or more polymers in a suitable solvent, which solution forms a solid polymeric material upon removal of the solvent, for example, by evaporation. Such polymeric materials, which can be solidified from, for example, a melt state or by solvent evaporation, are well known to those of ordinary skill in the art. A variety of polymeric materials, many of which are elastomeric, are suitable, and are also suitable for forming molds or mold masters, for embodiments where one or both of the mold masters is composed of an elastomeric material. A non-limiting list of examples of such polymers includes polymers of the general classes of silicone polymers, epoxy polymers, and acrylate polymers. Epoxy polymers are characterized by the presence of a three-membered cyclic ether group commonly referred to as an epoxy group, 1,2-epoxide, or oxirane. For example, diglycidyl ethers of bisphenol A can be used, in addition to compounds based on aromatic amine, triazine, and cycloaliphatic backbones. Another example includes the well-known Novolac polymers. Non-limiting examples of silicone elastomers suitable for use according to the invention include those formed from precursors including the chlorosilanes such as methylchlorosilanes, ethylchlorosilanes, phenylchlorosilanes, etc.

Silicone polymers are used in certain embodiments, for example, the silicone elastomer polydimethylsiloxane. Non-limiting examples of PDMS polymers include those sold under the trademark Sylgard by Dow Chemical Co., Midland, Mich., and particularly Sylgard 182, Sylgard 184, and Sylgard 186. Silicone polymers including PDMS have several beneficial properties simplifying fabrication of various structures of the invention. For instance, such materials are inexpensive, readily available, and can be solidified from a prepolymeric liquid via curing with heat. For example, PDMSs are typically curable by exposure of the prepolymeric liquid to temperatures of about, for example, about 65° C. to about 75° C. for exposure times of, for example, about an hour. Also, silicone polymers, such as PDMS, can be elastomeric and thus may be useful for forming very small features with relatively high aspect ratios, necessary in certain embodiments of the invention. Flexible (e.g., elastomeric) molds or masters can be advantageous in this regard.

One advantage of forming structures such as microfluidic structures or channels from silicone polymers, such as PDMS, is the ability of such polymers to be oxidized, for example by exposure to an oxygen-containing plasma such as an air plasma, so that the oxidized structures contain, at their surface, chemical groups capable of cross-linking to other oxidized silicone polymer surfaces or to the oxidized surfaces of a variety of other polymeric and non-polymeric materials. Thus, structures can be fabricated and then oxidized and essentially irreversibly sealed to other silicone polymer surfaces, or to the surfaces of other substrates reactive with the oxidized silicone polymer surfaces, without the need for separate adhesives or other sealing means. In most cases, sealing can be completed simply by contacting an oxidized silicone surface to another surface without the need to apply auxiliary pressure to form the seal. That is, the pre-oxidized silicone surface acts as a contact adhesive against suitable mating surfaces. Specifically, in addition to being irreversibly sealable to itself, oxidized silicone such as oxidized PDMS can also be sealed irreversibly to a range of oxidized materials other than itself including, for example, glass, silicon, silicon oxide, quartz, silicon nitride, polyethylene, polystyrene, glassy carbon, and epoxy polymers, which have been oxidized in a similar fashion to the PDMS surface (for example, via exposure to an oxygen-containing plasma). Oxidation and sealing methods useful in the context of the present invention, as well as overall molding techniques, are described in the art, for example, in an article entitled "Rapid Prototyping of Microfluidic Systems and Polydimethylsiloxane," *Anal. Chem.,* 70:474-480, 1998 (Duffy et al.), incorporated herein by reference.

Another advantage to forming channels or other structures (or interior, fluid-contacting surfaces) from oxidized silicone polymers is that these surfaces can be much more hydrophilic than the surfaces of typical elastomeric polymers (where a hydrophilic interior surface is desired). Such hydrophilic channel surfaces can thus be more easily filled and wetted with aqueous solutions than can structures comprised of typical, unoxidized elastomeric polymers or other hydrophobic materials.

In some, but not all, embodiments, one or more walls or portions of a channel may be coated, e.g., with a coating material, including photoactive coating materials. The coating materials can be used in certain instances to control and/or alter the hydrophobicity of the wall of a channel. In some embodiments, a sol-gel is provided that can be formed as a coating on a substrate such as the wall of a channel such as a microfluidic channel. One or more portions of the sol-gel can be reacted to alter its hydrophobicity, in some cases. For example, a portion of the sol-gel may be exposed to light, such as ultraviolet light, which can be used to induce a chemical reaction in the sol-gel that alters its hydrophobicity. The sol-gel may include a photoinitiator which, upon exposure to light, produces radicals. Optionally, the photoinitiator is conjugated to a silane or other material within the sol-gel. The radicals so produced may be used to cause a condensation or polymerization reaction to occur on the surface of the sol-gel, thus altering the hydrophobicity of the surface. In some cases, various portions may be reacted or left unreacted, e.g., by controlling exposure to light (for instance, using a mask).

The following documents are incorporated herein by reference: U.S. patent application Ser. No. 11/246,911, filed Oct. 7, 2005, entitled "Formation and Control of Fluidic Species," by Link, et al., published as U.S. Patent Application Publication No. 2006/0163385 on Jul. 27, 2006; U.S. Pat. No. 7,708,949, issued May 4, 2010, entitled "and Apparatus for Fluid Dispersion," by Stone, et al.; U.S. patent application Ser. No. 11/360,845, filed Feb. 23, 2006, entitled "Electronic Control of Fluidic Species," by Link, et al., published as U.S. Patent Application Publication No. 2007/0003442 on Jan. 4, 2007; U.S. patent application Ser. No. 11/885,306, filed Aug. 29, 2007, entitled "Method and Apparatus for Forming Multiple Emulsions," by Weitz, et al., published as U.S. Patent Application Publication No. 2009/0131543 on May 21, 2009; International Patent Application No. PCT/US2010/000753, filed Mar. 12, 2010, entitled "Scale-up of Microfluidic Devices," by Romanowsky, et al., published as WO 2010/104597 on Sep. 16, 2010; International Patent Application No. PCT/2010/054050, filed Oct. 26, 2010, entitled "Droplet Creation Techniques," by Weitz, et al.; and International Patent Application No. PCT/US2009/005184, filed Sep. 17, 2009, entitled "Creation of Libraries of Droplets and Related Species," by Weitz, et al., published as WO 2010/033200 on Mar. 25, 2010. Also incorporated herein by reference in its entirety is U.S. Provisional Patent Application Ser. No. 61/540,194, filed Sep. 28, 2011, entitled "Systems and Methods for Droplet Production and/or Fluidic Manipulation," by Sperling, et al.

The following examples are intended to illustrate certain embodiments of the present invention, but do not exemplify the full scope of the invention.

EXAMPLE 1

This example illustrates the fabrication of a device in accordance with one embodiment of the invention.

The microfluidic devices for both library generation and droplet detection were fabricated in PDMS by soft lithography. A typical device included two or three layers of PDMS (polydimethylsiloxane, Sylgard 184, Dow Corning), a commercially available, heat-curable silicone rubber.

Three-inch (1 inch=2.54 cm) silicon wafers were spin-coated with SU-8 series photoresist or laminated with TMMF (Tokyo Kogyo Co., Ltd.) dry film resist. After UV exposure and development, a thicker layer for the distribution channels and guide holes was applied to the wafer, which was then again exposed with UV light and developed. The masters were placed in a petri dish and cast with PDMS (Sylgard, curing agent:base=1:10). After curing at 65° C., the PDMS was peeled off the master and through-holes were punched. After cleaning with isopropanol, the surfaces of two slabs to be bonded together were activated with oxygen plasma and brought into contact with each other. After baking at 65° C., the PDMS slabs were irreversibly bonded.

The channel height of the PDMS devices was given by the film thickness of the photoresist. For this application, typical values were 30 micrometers height for drop makers and 200 to 400 micrometers for the distribution and collection channels. The first layer of PDMS contained the inlets for the individual samples to be encapsulated, inlet filters, and resistor channels, the array of junctions that serve for drop making, and distribution and collection channels for each two rows of drop makers. Each individual drop maker had its own sample inlet that included a 0.75 mm diameter through-hole, into which an about 1 inch long piece of 1/32 inch OD tubing was fitted to serve as an inlet tubing for each individual drop maker.

The second PDMS layer contained mirror images of the distribution and collection channels to increase their cross-section and via-holes to the third layer. The third layer contained two channels that connected the individual distribution and collection channels and one inlet hole for the oil phase and one outlet hole for the emulsion. The different layers of PDMS were fabricated individually and plasma-bonded on top of each other.

The dimensions of the dropmaker array were adapted to a standard 384 wellplate. The footprint for an individual device was 4.5 mm×4.5 mm. Hence, an array of 8×12=96 dropmakers took up a total area of 36×54 mm, which conveniently fitted onto a three-inch wafer that is routinely used for rapid prototyping.

EXAMPLE 2

This example illustrates a method of library generation, in accordance with one embodiment of the invention.

The setup for generating a droplet library used in this example included a pressure chamber with an inlet for oil and outlet tubing for the emulsion connected to the device, and a connector for compressed air. The pressure of the chamber was set by a manual pressure regulator connected to the compressed air line of the lab. A stop valve was positioned between the regulator and the pressure chamber, and a ventilation valve was positioned on the chamber. Both were used to pressurize or vent the pressure chamber.

The oil inlet was connected to a reservoir bottle containing the oil and surfactant, which was pressurized with compressed air. A manual pressure regulator was used to set the pressure, and a stop valve was used to control the flow without changing the pressure of the reservoir.

Samples were prepared in a 384 well plate, typically with a volume of 30 microliters to 70 microliters for each well. The parallel drop making device (see Example 1) was placed onto the plate such that the inlet tubings stuck into the wells of the plate, so that each individual sample goes into its dedicated drop maker. The well plate with the device on it was placed into the pressure chamber, and the oil inlet and emulsion outlet tubes inside the pressure chamber were connected to the device, before the chamber was closed tightly.

In a typical run, pressure values for both the oil reservoir and the pressure chamber were set with the pressure regulators, then both stop valves are opened. By this, oil flows into the device and the chamber were pressurized. The pressure drop between the inside of the chamber to the outlet of the device drove all the liquid samples through the device. When all the air had come out and the device was running stably, the emulsion was collected at the outlet tubing. As all devices were running in parallel and the outlets of individual drop makers went into corresponding collection channels, the emulsion collected at the outlet tubing was a mixture of all samples. This accordingly generated the library.

In some cases, a sample to be screened may be combined with a droplet library, e.g., as was discussed above. Once a droplet library has been generated, it can be stored and be used for one or more experiments. A given sample to be screened may be mixed with all samples of the library and the outcome of a chemical or biochemical reaction may be measured. In some cases, using droplets, a constant volume of the sample to be screened can be injected into the droplets of the library, e.g. by pairing up droplets and merging them, or through picoinjection. As the droplet library is a random mixture of droplets from all members of the library, Poisson statistics holds, so a sufficient number of droplets needs to be processed to cover the whole library. Also, just by processing more droplets, the coverage can be increased arbitrarily as desired.

EXAMPLE 3

This example illustrates detection and data analysis, in another embodiment of the invention.

Droplets such as those discussed above can be collected and stored in a syringe, or transferred to a syringe prior to reinjection into a detection device. In case of fluorinated oils, the aqueous droplets have a lower density than the surrounding oil phase. The droplets were reinjected as a closely packed emulsion, e.g., where they were sufficiently stabilized by surfactant and/or did not merge when they come into close contact.

The detection device included a cross-junction where the closely packed droplets were spaced out by additional oil before they enter the detection channel. In the case of monodisperse droplets and even flow rates, they were substantially evenly spaced and periodic.

For fluorescence detection, an excitation laser (488 nm, 50 mW) was focused into a detection channel, and the droplets flowed past. When the laser hits a droplet, fluorophores within the droplet were excited, and the emitted light was collected by the objective of a microscope (40×, 0.85 NA). With a series of dichroic mirrors and photomultiplier tubes, the fluorescent signal of each droplet was detected in a number of independent channels. The signal from the photomultipliers was processed in real time by a FPGA card performing peak detection, at an acquisition rate up to 200 kHz. The peak data was transferred to a computer where the data is saved, processed and visualized. All software used in this example was written in Labview (National Instruments) and Python (SciPy).

For a screening experiment, one or more channels can be used to detect the outcome of an assay, and one or more other channels can be used for fluorescent barcode labels. For example, one or more fluorescent dyes were added at different concentration levels to the samples making up the library, prior to encapsulation in droplets. The different concentration levels resulted in discrete levels of fluorescent signal, i.e. discrete intensity peaks for each channel. For two or more labels, for example, the dyes were added at fixed concentrations for each individual channel. The measured intensities resulted then in discrete clusters in two- or more dimensional detection space. By clustering algorithms, e.g. k-means, each individual droplet was assigned to a cluster or droplets, where each cluster corresponded to a different sample that had been encapsulated containing a combination of fluorophores to provide a unique label. For example, with $N_k$ levels in k channels, the total number of samples is given as the product over $N_k$, e.g. $10^4$ samples in case of four channels with each 10 discrete levels.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method, comprising:

providing, in a pressure chamber, a microfluidic device comprising a plurality of droplet-making units, each of the droplet-making units comprising one or more channels, each of the droplet-making units being substantially planar, each of the droplet-making units in fluidic communication with a different source of droplet fluid, and with a common source of carrier fluid via two or more substantially parallel channels in fluidic communication with the plurality of droplet-making units;

applying a common pressure from a pressure source to all of the different sources of droplet fluid to cause droplet fluid to move from the different sources of droplet fluid into the microfluidic device, wherein applying the common pressure comprises introducing a pressurizing fluid comprising air to all of the different sources of droplet fluid;

controlling the variability in flow resistance between the plurality of droplet-making units by flowing the droplet fluid through at least one channel within each droplet-making unit, the at least one channel having a length greater than two times the largest dimension of the droplet-making unit, such that the largest contribution of flow resistance between the plurality of droplet-making units is controlled by said length of the at least one channel; and producing, within the microfluidic device, a library of droplets, the library of droplets being contained within the carrier fluid;

wherein the library of droplets comprises:

a first plurality of droplets of the library containing a first species at a first concentration, and a second plurality of droplets of the library, the second plurality of droplets comprising the first species at a second concentration different from the first concentration, or comprising a second species different from the first species, wherein each produced droplet exits each droplet-making unit via one or more outlets into a collection channel, the collection channel in fluidic communication with the plurality of droplet-making units, wherein the one or more outlets has an increasing cross-sectional area; and flowing the library of droplets in the collection channel.

2. The method of claim 1, wherein applying the common pressure from a pressure source comprises providing the microfluidic device in a pressure chamber, and applying the common pressure via the pressure chamber.

3. The method of claim 1, wherein at least some of the different sources of droplet fluid are contained within an ANSI microwell plate, and applying the common pressure comprises applying a pressure to at least a portion of the ANSI microwell plate.

4. The method of claim 1, further comprising altering the common pressure applied to the different sources of droplet fluid based on the plurality of droplets of the set produced within the microfluidic device.

5. The method of claim 4, comprising determining at least some of the plurality of droplets of the set produced within the microfluidic device, and altering the common pressure applied to the pressure applied to the different sources of droplet fluid based on the determination.

6. The method of claim 4, comprising determining a rate of production of droplets produced within the microfluidic device, and altering the pressure applied to the different sources of droplet fluid based on the determination.

7. The method of claim 1, comprising producing at least about 100 droplets per second.

8. A method, comprising:

providing, in a pressure chamber, a microfluidic device comprising a plurality of droplet-making units, each of the droplet-making units comprising one or more channels, each of the droplet-making units being substantially planar, each of the droplet-making units in fluidic communication with a different source of droplet fluid, and with a common source of carrier fluid via two or more substantially parallel channels in fluidic communication with the plurality of droplet-making units, wherein all of the different sources of droplet fluid are open to a common environment within the pressure chamber;

applying, via the common environment, the same pressure and/or pressure drop to all of the different sources of droplet fluid to cause droplet fluid to move from the different sources of droplet fluid into the microfluidic device by increasing the pressure of the surrounding environment, wherein applying the same pressure and/or pressure drop comprises introducing a pressurizing fluid comprising air to all of the different sources of droplet fluid;

controlling the variability in flow resistance between the plurality of droplet-making units by flowing the droplet fluid through at least one channel within each droplet-making unit, the at least one channel having a length greater than two times the largest dimension of the droplet-making unit, such that the largest contribution of flow resistance between the plurality of droplet-making units is controlled by said length of the at least one channel; and producing, within the microfluidic device, a library of droplets, the library of droplets being contained within the carrier fluid from the source of carrier fluid;

wherein the library of droplets comprises:

a first plurality of droplets of the library containing a first species at a first concentration, and a second plurality of droplets of the library, the second plurality of droplets comprising the first species at a second concentration different from the first concentration, or comprising a second species different from the first species, wherein each produced droplet exits each droplet-making unit via one or more outlets into a collection channel, the collection channel in fluidic communication with the plurality of droplet-making units, wherein the one or more outlets has an increasing cross- sectional area; and flowing the library of droplets in the collection channel.

9. A method as in claim 8, comprising applying the same pressure and/or pressure drop to cause droplet fluid to move from the different sources of droplet fluid into the microfluidic device and to deliver the carrier fluid into the microfluidic device.

10. A method as in claim 1, wherein at least one of the droplet-making units comprises an inlet for receiving droplet fluid from one of the different sources of droplet fluid, the inlet in fluidic communication via a first microfluidic channel with an intersection of microfluidic channels, wherein a second microfluidic channel extends from the intersection, the second microfluidic channel in fluid communication with the source of carrier fluid, wherein at least one of the first or second microfluidic channels has a length within the droplet-making unit that is greater than two times the largest dimension of the droplet-making unit.

11. A method as in claim 8, wherein at least one of the droplet-making units comprises an inlet for receiving droplet fluid from one of the different sources of droplet fluid, the inlet in fluidic communication via a first microfluidic channel with an intersection of microfluidic channels, wherein a second microfluidic channel extends from the intersection, the second microfluidic channel in fluid communication with the source of carrier fluid, wherein at least one of the first or second microfluidic channels has a length within the droplet-making unit that is greater than two times the largest dimension of the droplet-making unit.

12. A method, comprising:

providing, in a pressure chamber, a microfluidic device comprising a plurality of droplet-making units and a plurality of substantially parallel channels therein configured to distribute carrier fluid from a common source of carrier fluid to substantially each of the droplet-making units, each of the droplet-making units comprising one or more channels, wherein each of the droplet-making units is in fluidic communication with a different source of droplet fluid and the common source of carrier fluid and wherein each of the droplet-making units are substantially planar;

applying the same pressure and/or pressure drop to all of the different sources of droplet fluid and the common source of carrier fluid to cause droplet fluid to move from the different sources of droplet fluid into the microfluidic device and to cause carrier fluid to move from the common source of carrier fluid into the microfluidic device, wherein applying the same pressure and/or pressure drop to all of the different sources of droplet fluid and the common source of carrier fluid comprises applying a common pressure from a pressure source;

controlling the variability in flow resistance between the plurality of droplet-making units by flowing the droplet fluid through at least one channel within each droplet-making unit, the at least one channel having a length greater than two times the largest dimension of the droplet-making unit, such that the largest contribution of flow resistance between the plurality of droplet-making units is controlled by said length of the at least one channel; and producing, within the microfluidic device, a library of droplets, the library of droplets being contained within the carrier fluid from the common source of carrier fluid;

wherein the library of droplets comprises:

a first plurality of droplets of the library containing a first species at a first concentration, and a second plurality of droplets of the library, the second plurality of droplets comprising the first species at a second concentration different from the first concentration, or comprising a second species different from the first species, wherein each produced droplet exits each droplet-making unit via one or more outlets into a collection channel, the collection channel in fluidic communication with the plurality of droplet-making units, wherein the one or more outlets has an increasing cross- sectional area; and flowing the library of droplets in the collection channel.

13. A method as in claim 10, wherein at least one of the first microfluidic channel or the second microfluidic channel has a serpentine flow pathway.

14. A method as in claim 10, wherein the carrier fluid enters the inlet though a channel to a T-junction which splits into a third microfluidic channel and a fourth microfluidic channel, each in fluidic communication with the one or more outlets.

15. A method as in claim 1, wherein an inlet in fluidic communication with a common source of carrier fluid is centrally positioned within the droplet-making unit.

16. A method as in claim 15, further comprising an inlet filter in fluidic communication with the centrally positioned inlet.

17. A method as in claim 10, further comprising an inlet filter in fluidic communication with the inlet.

* * * * *